US010926530B2

(12) United States Patent
Fukazawa et al.

(10) Patent No.: US 10,926,530 B2
(45) Date of Patent: Feb. 23, 2021

(54) SCREEN PRINTING METHOD AND DEVICE THEREFOR

(71) Applicant: MURAKAMI CORPORATION, Shizuoka (JP)

(72) Inventors: Akihiko Fukazawa, Shizuoka (JP); Yoshihito Homma, Yaizu (JP)

(73) Assignee: MURAKAMI CORPORATION, Shizuoka (JP)

( * ) Notice: Subject to any disclaimer, the term of this patent is extended or adjusted under 35 U.S.C. 154(b) by 64 days.

(21) Appl. No.: 15/774,156

(22) PCT Filed: Nov. 12, 2016

(86) PCT No.: PCT/JP2016/083617
§ 371 (c)(1),
(2) Date: May 7, 2018

(87) PCT Pub. No.: WO2017/082428
PCT Pub. Date: May 18, 2017

(65) Prior Publication Data

US 2018/0326717 A1 Nov. 15, 2018

(30) Foreign Application Priority Data

Nov. 14, 2015 (JP) ..... JP2015-223537

(51) Int. Cl.
*B41F 15/30* (2006.01)
*B41F 15/42* (2006.01)
(Continued)

(52) U.S. Cl.
CPC ..... *B41F 15/0895* (2013.01); *B41F 15/30* (2013.01); *B41F 15/38* (2013.01);
(Continued)

(58) Field of Classification Search
CPC ..... B41F 15/0895; B41F 15/30; B41F 15/38; B41F 15/42; B41F 15/46; B41F 15/423
See application file for complete search history.

(56) References Cited

U.S. PATENT DOCUMENTS 4,648,317 A * 3/1987 Bubley ..... B41F 15/42 101/123
5,388,508 A * 2/1995 Dubuit ..... B41F 15/44 101/120

(Continued)

FOREIGN PATENT DOCUMENTS

CN 1380181 11/2002
CN 101384436 3/2009

(Continued)

OTHER PUBLICATIONS

Office Action issued in China Counterpart Patent Appl. No. 201680066542.6, dated Mar. 29, 2019, along with an English translation thereof.

(Continued)

*Primary Examiner* — Matthew G Marini
*Assistant Examiner* — Marissa Ferguson-Samreth
(74) *Attorney, Agent, or Firm* — Greenblum & Bernstein, P.L.C.

(57) ABSTRACT

A printing object surface has a cross-sectional shape curving along a printing advancing direction. The printing advancing direction is defined as a Y-axis, a direction orthogonal to the Y-axis and belonging to the cross-section is defined as a Z-axis, and a direction around an axis orthogonal to a Y-Z plane is defined as a θ-axis. A squeegee is disposed so as to be movable in the respective Y-, Z- and θ-axis directions. Information indicating a mutual relationship among respective Y-, Z- and θ-axis positions is obtained. The relationship is a relationship that enables performing printing while maintaining or substantially maintaining an angle formed by (Continued)

a direction tangent to a printing position in the printing object surface in the Y-Z plane and the squeegee. Printing is executed while the respective Y-, Z-, θ-axis positions of the squeegee relative to the printing object surface are controlled according to the obtained information.

13 Claims, 14 Drawing Sheets

(51) Int. Cl.
*B41F 15/08* (2006.01)
*B41F 15/46* (2006.01)
*B41F 15/38* (2006.01)

(52) U.S. Cl.
CPC ..... *B41F 15/42* (2013.01); *B41F 15/423* (2013.01); *B41F 15/46* (2013.01)

(56) References Cited

U.S. PATENT DOCUMENTS 5,660,875 A * 8/1997 Muchi ..... B41F 15/085 427/64
5,702,526 A 12/1997 Muchi et al.
5,744,191 A 4/1998 Muchi et al.
6,041,702 A * 3/2000 Ichikawa ..... B41F 15/0895 101/123
6,092,463 A 7/2000 Onishi et al.
6,698,345 B2 * 3/2004 Cutcher ..... B41F 15/0895 101/123
6,715,415 B2 4/2004 Yamasaki et al.
7,182,019 B2 * 2/2007 Cutcher ..... B41F 15/0895 101/123
8,561,535 B2 10/2013 Sabia et al.
2002/0007740 A1 1/2002 Cutcher
2002/0148369 A1 10/2002 Yamasaki et al.
2004/0149152 A1 * 8/2004 Edson ..... B41F 15/04 101/127
2005/0160927 A1 7/2005 Cutcher et al.
2007/0084362 A1 * 4/2007 Kim ..... B41F 15/36 101/123
2009/0101027 A1 4/2009 Goetz et al.
2010/0186611 A1 7/2010 Miyahara et al.
2011/0209634 A1 * 9/2011 Sabia ..... B41F 15/0895 101/129
2018/0264800 A1 * 9/2018 Ito ..... B41M 1/12
2018/0333948 A1 * 11/2018 Matsuda ..... B41F 15/0895

FOREIGN PATENT DOCUMENTS

CN 102238811 11/2011
JP 48-25039 3/1973
JP 01171944 * 7/1989 ..... B41F 15/40
JP 6-31895 2/1994
JP 06031895 * 2/1994 ..... B41F 15/08
JP 7-262919 10/1995
JP 09216338 * 8/1997
JP 2003-535735 12/2003
JP 2008-528323 7/2008
JP 2012-30507 2/2012
WO 2006/082011 8/2006
WO 2019074800 * 4/2019 ..... B41F 15/0872

OTHER PUBLICATIONS

International Search Report issued in PCT/JP2016/083617, dated Jan. 24, 2017, along with an english translation thereof.
Written Opinion of the International Searching Authority issued in PCT/JP2016/083617, dated Jan. 24, 2017 and English translation thereof.

* cited by examiner

SCREEN PRINTING METHOD AND DEVICE THEREFOR

The disclosure of Japanese Patent Application No. JP2015-223537 filed on Nov. 14, 2015 including the specification, drawings, claims and abstract is incorporated herein by reference in its entirety.

TECHNICAL FIELD

This invention relates to a screen printing method and a device therefor. This invention provides a screen printing method that enables high-precision or high-quality printing on any of printing object surfaces having various cross-sectional shapes each curving along a printing advancing direction and a device therefor.

BACKGROUND ART

Patent Literatures 1 and 2 indicated below each describe a screen printing device that performs screen printing on a printing object surface having a cross-sectional shape curving along a printing advancing direction. In the screen printing device described in Patent Literature 1, a guide rail is shaped so as to fit a cross-sectional shape of a printing object surface, and is disposed. This screen printing device performs printing on the printing object surface by moving a squeegee along the guide rail. In another screen printing device described in Patent. Literature 1, a guide rail is provided as a linear member. This screen printing device performs printing on the printing object surface by moving the squeegee along the guide rail while adjusting a position of the squeegee so as to follow the cross-sectional shape of the printing object surface using a program. In the screen printing device described in Patent Literature 2, a squeegee is supported at a bottom of a pendulum. This screen printing device performs printing on a printing object surface by pendular movement of the pendulum on a screen.

CITATION LIST

Patent Literature

Patent Literature 1: Japanese Patent Laid-Open No. 2008-528323

Patent Literature 2: Japanese Patent Laid-Open No. 2003-535735

SUMMARY OF INVENTION

Technical Problem

The screen printing device described in Patent Literature 1 uses a guide rail shaped so as to fit a cross-sectional shape of a printing object surface. This screen printing device requires, for each of printing object surfaces having different cross-sectional shapes, providing a guide rail fitting the cross-sectional shape. Also, another screen printing device describe in Patent Literature 1 uses a guide rail made of a linear member. The other screen printing device has the problem of instability in printing state because an angle formed by a printing object surface and a squeegee varies depending on the printing position in the printing advancing direction in the printing object surface. Also, in the screen printing device described in Patent Literature 2, the squeegee performs pendular movement. This screen printing device requires changing the length of the pendulum according to the curvature of the printing object surface, and in particular, requires a long pendulum for a printing object surface having large curvature.

This invention solves the aforementioned problems other words, this invention provides a screen printing method that enables high-precision or high-quality printing on any of printing object surfaces having various cross-sectional shapes each curving along a printing advancing direction and a device therefor.

Solution to Problem

A screen printing method according to this invention is a screen printing method for screen printing on a printing object surface having a cross-sectional shape curving along a printing advancing direction, the method including: where the printing advancing direction is defined as a Y-axis, a direction orthogonal to the Y-axis and belonging to the cross-section is defined as a Z-axis and a direction around an axis orthogonal to a Y-Z plane is defined as a θ-axis, disposing a squeegee so as to be movable in respective Y-, Z- and θ-axis directions relative to the printing object surface; obtaining information indicating a mutual relationship among respective Y-, Z- and θ-axis positions, the relationship enabling performing printing while maintaining or substantially maintaining an angle formed by a direction tangent to a printing position in the printing object surface in the Y-Z plane and the squeegee; and executing printing while controlling the respective Y-, Z- and θ-axis positions of the squeegee relative to the printing object surface according to the obtained information indicating the mutual relationship among the respective Y-, Z- and θ-axis positions. Accordingly, printing can be performed on any of printing object surfaces having various cross-sectional shapes curving along a printing advancing direction while an angle formed by a direction tangent to a printing position in the printing object surface and the squeegee is maintained or substantially maintained, enabling high-precision or high-quality printing on the printing object surface.

The screen printing method according to this invention can include, for example, obtaining the information indicating the mutual relationship among the respective Y-, Z- and θ-axis positions before execution of printing and setting the information in advance, and executing printing while controlling the respective Y-, Z- and θ-axis positions of the squeegee relative to the printing object surface according to the set information indicating the mutual relationship among the respective Y-, Z- and θ-axis positions. Accordingly, information indicating a mutual relationship among respective Y-, Z- and θ-axis positions is obtained before execution of printing and set in advance, eliminating the need for arithmetic operation to obtain information indicating a mutual relationship among respective Y-, Z- and θ-axis positions during execution of printing and thus enabling decrease in amount of arithmetic operation during execution of printing.

In the screen printing method according to this invention, for example, the information indicating the mutual relationship among the respective Y-, Z- and θ-axis positions can be obtained based on data on the cross-sectional shape of the printing object surface or data on a shape approximating the cross-sectional shape. Accordingly, information indicating a mutual relationship among respective Y-, Z- and θ-axis positions can he obtained based on data on a cross-sectional shape of a printing object surface or data on a shape approximating the cross-sectional shape (for example, a cross-sectional shape of a screen, the cross-sectional shape approximating a cross-sectional shape of a printing object surface).

In the screen printing method according to this invention, for example, the information indicating the mutual relationship among the respective Y-, Z- and θ-axis positions can be obtained as information with variation in the Y-axis position and the Z-axis position due to variation in the θ-axis position taken into consideration. Accordingly, even if the θ-axis position of the squeegee varies during execution of printing, the printing can be performed while a position of a distal end of the squeegee relative to a printing object surface is maintained or substantially maintained, enabling higher-precision or higher-quality printing on the printing object surface.

In the screen printing method according to this invention, for example, the printing can be executed using a screen having a cross-sectional shape curving along the printing advancing direction so as to follow or substantially follow the printing object surface. Accordingly, printing can be performed in a state in which a screen is disposed so as to maintain or substantially maintain a clearance between a printing object surface and the screen, enabling higher-precision or higher-quality printing on the printing object surface.

In the screen printing method according to this invention, for example, the printing can be executed while a printing speed in the direction tangent to the printing position in the printing object surface in the Y-Z plane is maintained or substantially maintained. Accordingly, printing can be performed while a printing speed in a direction tangent to a printing position in a printing object surface is maintained or substantially maintained, enabling higher-precision or higher-quality printing on the printing object surface. The control of the printing speed can be performed, for example, according to the following procedure. The information indicating the mutual relationship among the respective Y-, Z- and θ-axis positions for each of positions with an interval of a predetermined distance along the printing object surface is obtained before execution of printing and set in advance. The information is sequentially read at a time interval according to a designated printing speed and the information is provided as position instruction values for the respective Y, Z, θ-axes to control the respective axes.

A screen printing device according to this invention is a screen printing device for screen printing on a printing object surface having a cross-sectional shape curving along a printing advancing direction, the apparatus including: a squeegee; a doctor; a movement unit that where the printing advancing direction is defined as a Y-axis, a direction orthogonal to the Y-axis and belonging to the cross-section is defined as a Z-axis and a direction around an axis orthogonal to a Y-Z plane is defined as a θ-axis, moves the squeegee relative to the printing object surface in respective Y-, Z- and θ-axis directions; and a control unit that obtains information indicating a mutual relationship among respective Y-, Z- and θ-axis positions, the relationship enabling performing printing while maintaining or substantially maintaining an angle formed by a direction tangent to a printing position in the printing object surface in the Y-Z plane and the squeegee, or the information being set in the control unit, and at a time printing via the squeegee, controls the movement unit according to the information so as to control the respective Y-, Z- and θ-axis positions of the squeegee relative to the printing object surface to be respective positions according to the information. Accordingly, printing can be performed on any of printing object surfaces having various cross-sectional shapes each curving along a printing advancing direction while an angle formed by a direction tangent to a printing position in the printing object surface and the squeegee is maintained or substantially maintained. Therefore, high-precision or high-quality printing can be performed on the printing object surface.

The screen printing device according to this invention can be configured, for example, so that: the screen printing device includes a memory that stores, in advance, the information indicating the mutual relationship among the respective Y-, Z- and θ-axis positions in a form of information that is a combination of positional data of the respective Y-, Z- and θ-axis positions; and the control unit controls the movement unit with reference to the memory to control the respective Y-, Z- and θ-axis positions of the squeegee relative to the printing object surface to be respective positions according to the information stored in the memory. Accordingly, printing can be performed while the respective Y-, Z- and θ-axis positions of the squeegee are controlled with reference to the memory, enabling decrease in amount of arithmetic operation during execution of printing compared to a case where printing is performed while the respective Y-, Z- and θ-axis positions of the squeegee are obtained by sequential arithmetic operation during the printing.

In the screen printing device according to this invention, the control unit can, for example, execute the printing while maintaining or substantially maintaining a printing speed in the direction tangent to the printing position in the printing object surface in the Y-Z plane. Accordingly, printing can be performed while a printing speed in a direction tangent to a printing position in a printing object surface is maintained or substantially maintained, enabling higher-precision or hi her-quality printing on the printing object surface. The control of the printing speed can be performed, for example, according to the following procedure. The information indicating the mutual relationship among the respective Y-, Z- and θ-axis positions for each of positions with an interval of a predetermined distance along the printing object surface is stored in the memory. The control unit sequentially reads the information indicating the mutual relationship among the respective Y-, Z- and θ-axis positions at a time interval according to a designated printing speed, from the memory and provides the information as position instruction values for the respective Y-, Z- and θ-axes to control the respective axes.

The screen printing device according to this invention can be configured so that: the movement unit includes a mechanism that moves the squeegee and the doctor together in the respective Y-, Z- and θ-axis directions relative to the printing object surface; and the control unit obtains information indicating a mutual relationship among respective Y-, Z- and θ-axis positions, the relationship enabling returning an ink while maintaining or substantially maintaining an angle formed by a direction tangent to a screen at a place of abutment between the doctor and a screen when the doctor returning the ink and the doctor, or the information is set in the control unit, and at a time of return of the ink by the doctor, the control unit controls respective Y-, Z- and θ-axis positions of the doctor relative to the screen according to the obtained or set information indicating the mutual relationship among the respective Y-, Z- and θ-axis positions. Accordingly, uniform ink coating (ink return or ink recovery) can be performed on a screen free from the influence of the cross--sectional shape of the screen, enabling enhancement in quality of next printing.

In the screen printing device according to this invention, the movement unit can include, for example, a mechanism that fixes a position of the printing object surface and moves the squeegee in the respective Y-, Z- and θ-axis directions. Accordingly, printing can be performed with a position of a printing object surface fixed.

In the screen printing device according to this invention, the movement unit can be configured, for example, as follows. A Z- (or Y-) axis stage is mounted on a Y- (or Z-) axis stage. A θ-axis stage is mounted on the (or Y-) axis stage. The squeegee is mounted on the θ-axis stage. A printing pressure fine adjustment mechanism is mounted on the θ-axis stage. The printing fine adjustment mechanism moves the squeegee by a slight amount in a direction in which the squeegee is brought close to or away from the printing object surface to perform fine adjustment of printing pressure. Accordingly, mounting the printing pressure fine adjustment mechanism on the θ-axis stage to perform printing pressure adjustment enables easy printing pressure adjustment compared to a case where printing pressure adjustment is performed by adjustment of the position in the Z-axis direction of the θ-axis stage.

The screen printing device according to this invention can be configured, for example, so that a doctor pressure fine adjustment mechanism that moves the doctor by a slight amount in a direction in which the doctor is brought close to or away from a surface of the screen to perform fine adjustment of doctor pressure is mounted on the θ-axis stage. Accordingly, mounting the doctor pressure fine adjustment mechanism on the θ-axis stage to perform doctor pressure adjustment enables easy doctor pressure adjustment compared to a case where doctor pressure adjustment is performed by adjustment of the position in the Z-axis direction of the θ-axis stage.

DESCRIPTION OF EMBODIMENTS

Figure 1:
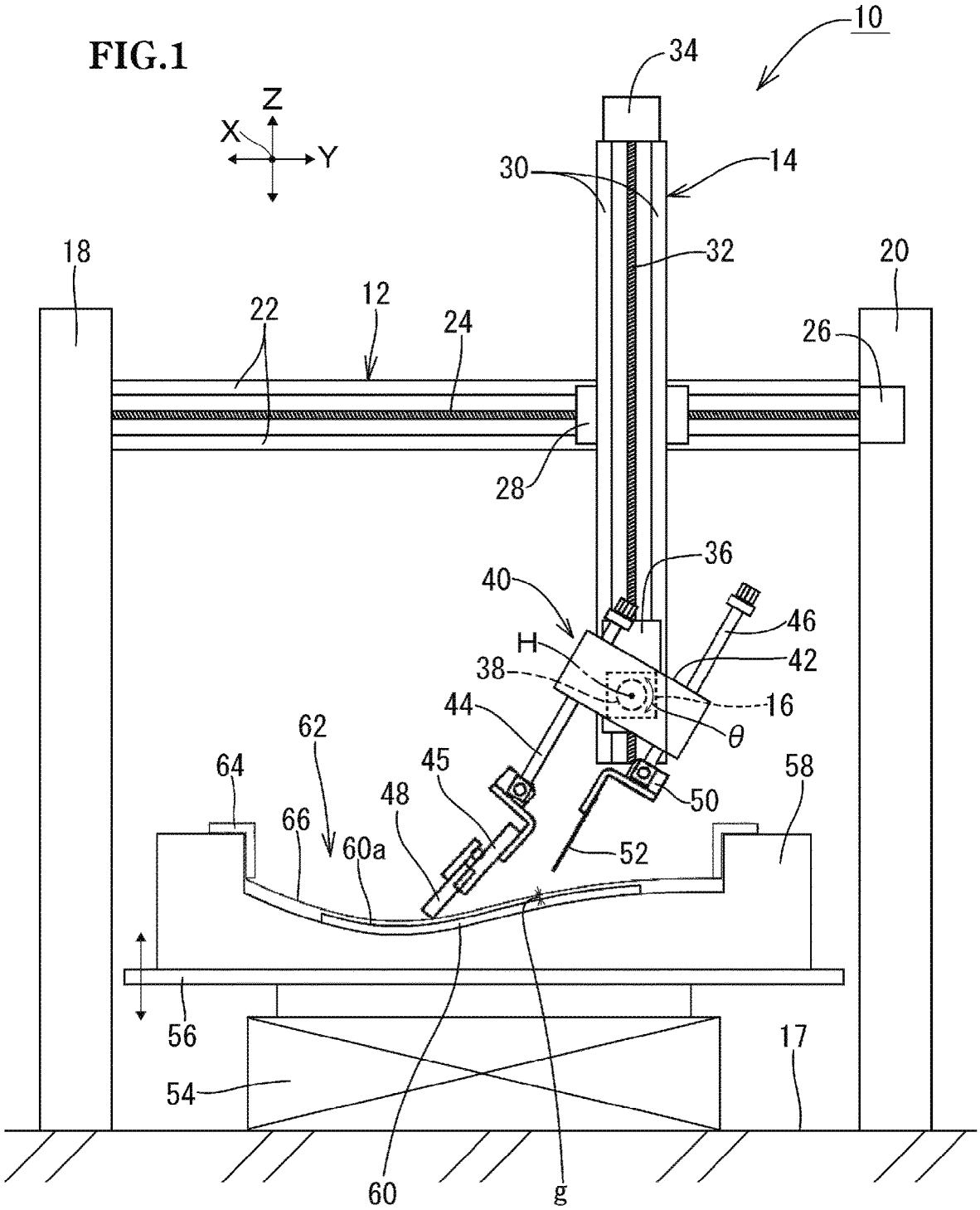
FIG. 1 is a schematic diagram illustrating an embodiment of a mechanism section of a screen printing device according to this invention, which illustrates an arrangement on a Y-Z plane (a screen printing plate, a fixture therefor and a printing object are illustrated in a cross-section along the Y-Z plane).
Figure 2A:
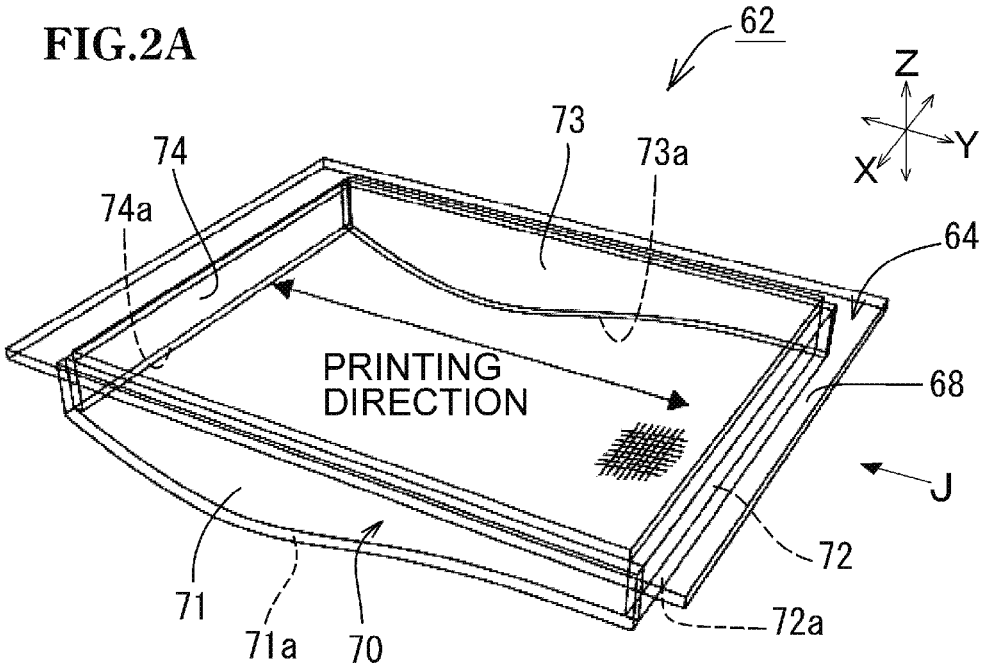
FIG. 2A is a perspective view illustrating a configuration of the screen printing plate in FIG. 1.
Figure 2B:
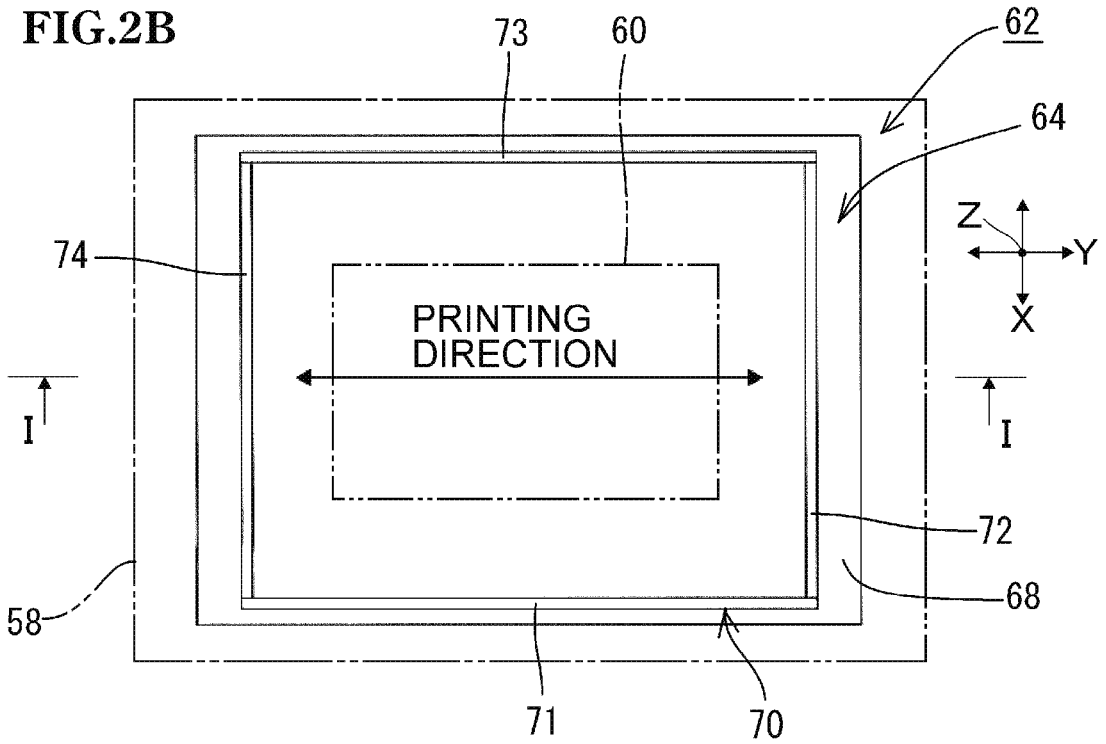
FIG. 2B is a plan view of the screen printing plate in FIG. 2A.
Figure 2C:
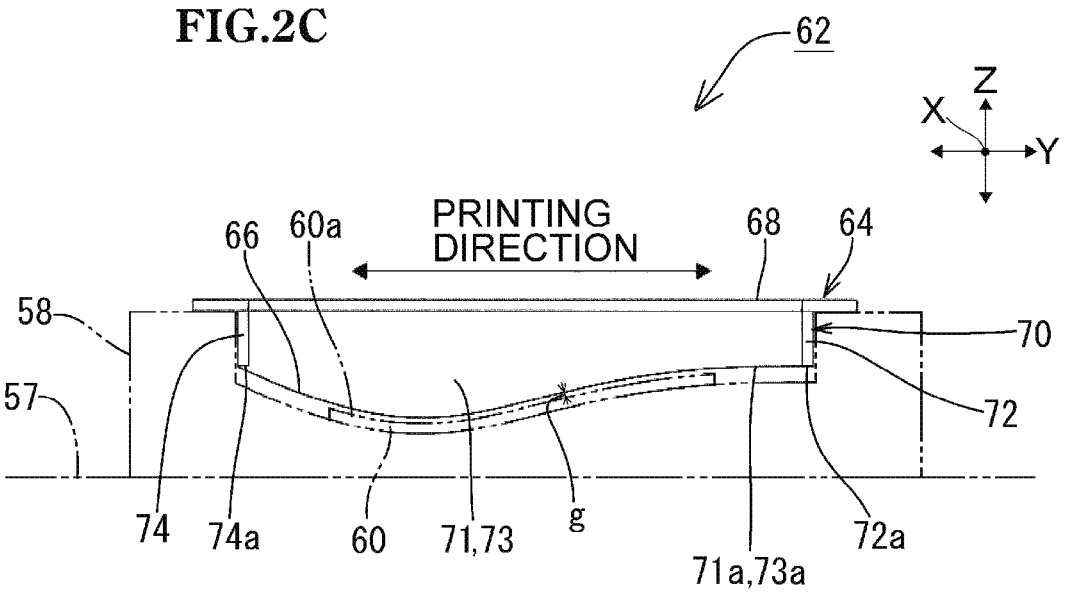
FIG. 2C is a cross-sectional view along lines indicated by arrows I-I in FIG. 2B.
Figure 2D:
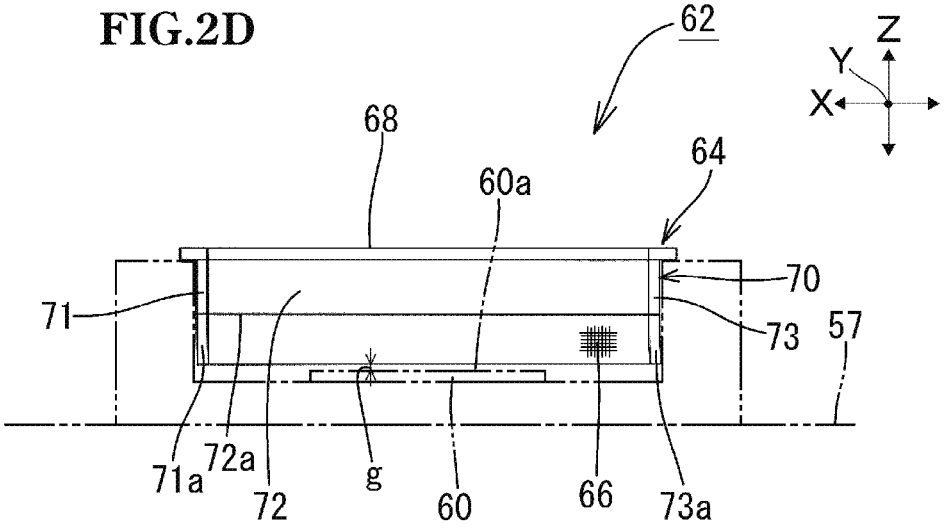
FIG. 2D is a diagram as viewed in the direction indicated by arrow J in FIG. 2A.

Embodiments of this invention will be described. FIG. 1 illustrates an embodiment of a mechanism section of a screen printing device 10 according to this invention. The screen printing device 10 has three movement axes of a Y-axis stage 12, a Z-axis stage 14 and a θ-axis stage 16. The Y-axis stage 12 and the Z-axis stage 14 can be each formed of a commercially available appropriate electric linear stage, and the θ-axis stage 16 can be formed of a commercially available appropriate electric rotary stage.

Left and right struts 18, 20 are fixed in a standing manner to a mount 17 of a body of the screen printing device 10. Opposite ends in a longitudinal direction of the Y-axis stage 12 are fixed to and supported by the left and right struts 18, 20. Consequently, the Y-axis stage 12 is fixedly disposed in the body of the screen printing device 10 so as to extend in a horizontal direction (Y-axis direction, that is, the left-right direction in FIG. 1). Two rails 22 are fixedly arranged in the Y-axis stage 12 so as to extend in the Y-axis direction. Between the two rails 22, a ball screw 24 is arranged in parallel with the rails 22. The ball screw 24 is driven to rotate, by a servo motor 26. A Y-axis mount 28 is attached to the rails 22 so as to be movable alone the rails 22. The Y-axis mount 28 is threadably connected to the ball screw 24 and is transported in the Y-axis direction on the Y-axis stage 12 by rotation of the ball screw 24 driven by the servo motor 26.

The Z-axis stage 14 is fixedly supported on the Y axis mount 28 so as to extend in a vertical direction (Z-axis direction, that is, the top-bottom direction in FIG. 1). Two rails 30 are fixedly disposed in the Z-axis stage 14 so as to extend in the Z-axis direction. Between the two rails 30, a ball screw 32 is arranged in parallel with the rails 30. The ball screw 32 is driven to rotate, by a servo motor 34. A Z-axis mount 36 is attached to the rails 30 so as to be movable along the rails 30. The Z-axis mount 36 is threadably connected to the ball screw 32 and is sported in the Z-axis direction on the Z-axis stage 14 by rotation of the ball screw 32 driven by the servo motor 34.

The θ-axis stage 16 is fixedly supported on the Z-axis mount 36. The θ-axis stage 16 can be moved to an arbitrary position on a Y-Z plane (vertical plane), by movements of the Y-axis mount 28 and the Z-axis mount 36. The θ-axis stage 16 includes a rotation shaft 38 (rotation axis rod). An axis H of the rotation shaft 38 is disposed in parallel with an X-axis. The X-axis is an axis in a horizontal direction orthogonal to the Y-Z plane (direction orthogonal to the sheet of FIG. 1). The θ-axis is an axis in a direction around the axis H. The rotation shaft 38 is driven to rotate in the θ-axis direction, by a servo motor (indicated by reference numeral 35 in FIG. 5 and not illustrated in FIG. 1) incorporated in the θ-axis stage 16. A printing head 4 is fixed to an end of the rotation shaft 38. Consequently, the printing head 40 is transported (rotated) in the θ-axis direction, by rotation of the rotation shaft 38.

Figure 4A:
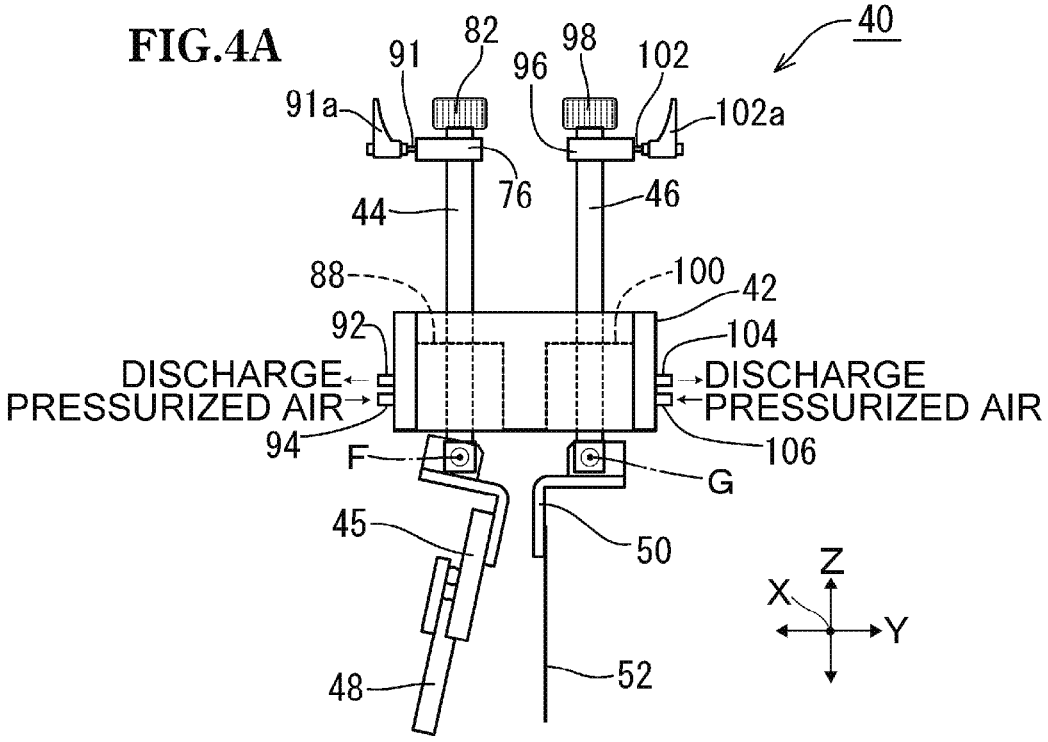
FIG. 4A is a diagram of the printing head in FIG. 1 as viewed from a lateral side of the squeegee and the doctor, which illustrates a neutral state in which each of the squeegee and the doctor is in a raised, standby position.
Figure 4B:
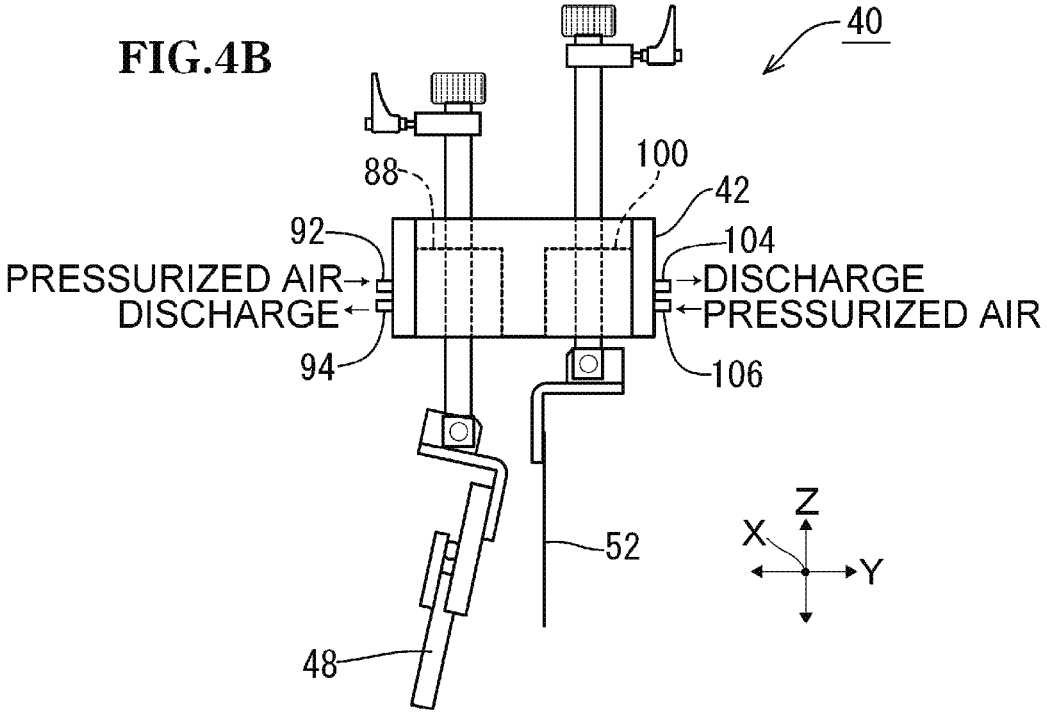
FIG. 4B is a diagram of the printing head in FIG. 1 as viewed from a position that is the same as that of FIG. 4A, which illustrates a printing state in which the squeegee is in a lowered, printing operation position and the doctor is in a raised, standby position.
Figure 4C:
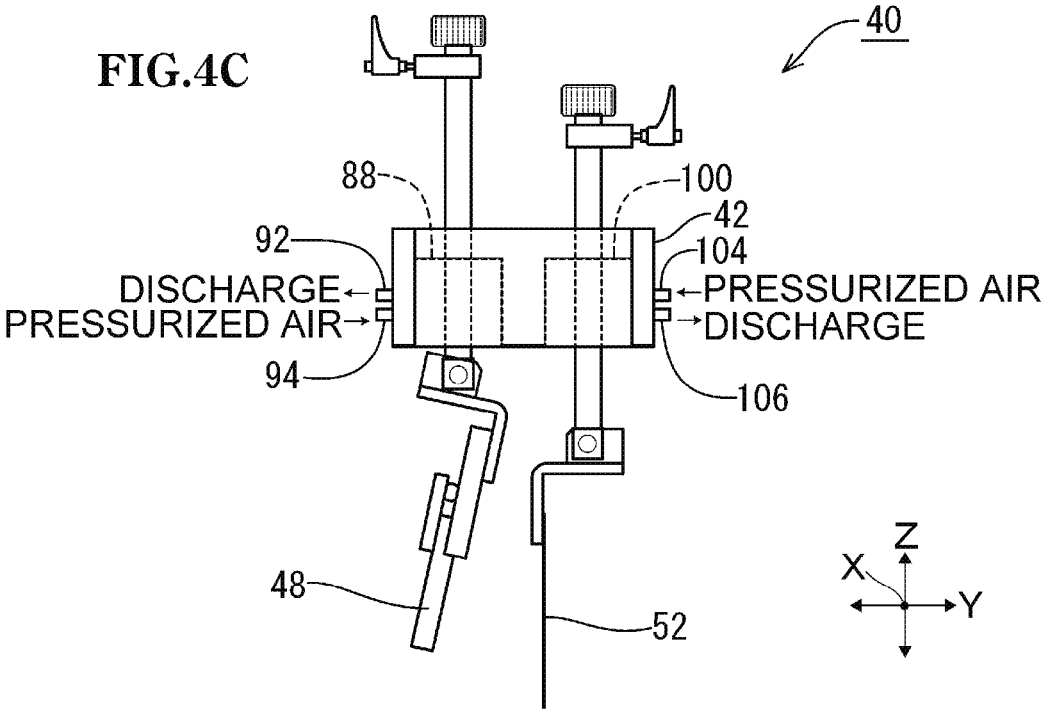
FIG. 4C is a diagram of the printing head in FIG. 1 as viewed from a position that is the same as those of FIGS. 4A and 4B, which illustrates a state in which the squeegee is in a raised, standby position and the doctor is in a lowered, ink coating operation position.

The printing head 40 includes a base block 42 fixedly supported on the end of the rotation shaft 38. Guide shafts 44, 46 are inserted and held through the base block 42 at respective positions on opposite sides of the rotation shaft across the rotation axis (axis H) of the rotation shaft 38 so as to be movable in respective axis directions of the guide shafts 44, 46. As described later, the guide shafts 44, 46 are individually moved in the axis directions, by respective air cylinders 88, 100 (FIGS. 4A, 4B and 4C). The guide shafts 44, 46 are arranged in parallel with each other in the base block 42. Upon rotation of the base block 42, the guide shafts 44, 46 rotate together with the base block 42. A position in which the axes of the guide shafts 44, 46 extend vertically (position parallel to the Z-axis) is a position at which a θ-axis angle is 0 degrees. A squeegee 48 is attached to lower ends of the guide shafts 44 via a squeegee holder 45. In this embodiment, as the squeegee 48, a flat-type squeegee having a horizontally-long rectangular front shape (shape as viewed in a direction parallel to the Y-axis direction) is used. A hardness of the squeegee 48 is, for example, 60 to 70 degrees. A doctor 52 is attached to lower ends of the guide shafts 46 via a doctor holder 50.

A table 56 is fixedly supported on the mount 17 of the body of the screen printing device 10 via a lift 54. The table 56 is raised and lowered, with a horizontal position thereof kept, by the lift 54. A fixture 58 is mounted and fixed at a position at which the fixture 58 faces the printing head 40, on the table 56. A printing object 60 is mounted and supported on a center of an upper surface of the fixture 58. The printing object 60 is, for example, a glass plate, a resin plate or the like having a constant thickness. A surface (printing object surface) 60*a* of the printing object 60 has a cross-sectional shape curving along a printing advancing direction (Y-axis direction). In this embodiment, a cross-sectional shape in the X-axis direction of the printing object surface 60*a* is linear in parallel with the X-axis. In other words, the printing object surface 60*a* is a two-dimension curved surface curved along the Y-axis direction. However, even if the cross-sectional shape in the X-axis direction of the printing object surface 60*a* includes a curve or a fold (that is, even if the printing object surface 60*a* is a three dimension curved surface), by making cross-sectional shapes in the X-axis direction of the squeegee 48 and the doctor 52 to respective shapes that fit the cross-sectional shape in the X-axis direction of the printing object surface 60*a*, it is possible to print on the printing object surface 60*a*. A surface of the fixture 58 is curved so as to fit the curved shape of the printing object surface 60*a*. A screen printing plate 62 is mounted and supported on the fixture 58 on which the printing object 60 is mounted and supported. The screen printing plate 62 has a structure in which a screen 66 is stretched in a frame member (reinforced plate frame for curved printing) 64. The screen 66 is stretched so as to curve along the curved shape of the printing object surface 60*a*. The screen 66 faces the printing object surface 60*a* with a predetermined clearance g therebetween.

With the above-described arrangement in FIG. 1, printing on the printing object surface 60*a* is performed as follows. The squeegee 48 is held in a lowered position by the guide shafts 44. The doctor 52 is held in a raised position by the guide shafts 46. In this state, the printing head 40 is transported in the Z-axis direction so as to fit the cross-sectional shape in the Y-axis direction of the printing object surface 60*a* while the printing head 40 is transported in the Y-axis direction. Consequently, the squeegee 48 rubs the screen 66 coated with an ink, under predetermined printing pressure, whereby printing on the printing object surface 60*a* is performed. At this Lime, concurrently, the printing head 40 is rotated in the θ-axis direction according to the cross-sectional shape in the Y-axis direction of the printing object surface 60*a* to adjust the θ-axis position. Consequently, the printing is performed with an angle formed by a direction tangent to a printing position (that is, a direction tangent to the printing position in the cross-sectional shape in the Y-axis direction of the printing object surface 60*a*) and the squeegee 48 (attack angle) kept constant. Also, Y-axis, Z-axis and θ-axis movement speeds are controlled so that a speed of the printing on the printing object surface 60*a* is constant, to perform the printing. Consequently, high-quality curved surface printing is achieved.

FIGS. 2A to 2D illustrate a structure of the screen printing plate 62. The screen printing plate 62 has a configuration in which the screen 66 is stretched in the frame member 64. The frame member 64 is formed of a material of, e.g., wood, plastic or metal. The frame member 64 includes an upper frame 68 and a wall 70 each having a rectangular shape in plan view. The upper frame 68 is formed of a flat plate, and is to be mounted and supported on the fixture 58. The wall 70 is joined to an inner peripheral edge of the upper frame 68 and formed to hang down from the entire inner peripheral edge. From among four plates 71, 72, 73, 74 forming the wall 70, two plates 71, 73 are disposed along the Y-axis direction. Lower surfaces 71*a*, 73*a* of the plates 71, 73 are formed so as to curve in the Z-axis direction, along the Y-axis direction so as to fit the cross-sectional shape in the Y-axis direction of the printing object surface 60*a*. Also, two plates 72, 74 are disposed along the X-axis direction. Lower surfaces 72*a*, 74*a* of the plates 72, 74 are formed linearly in parallel with the X-axis, along the X-axis direction, so as to fit the cross-sectional shape in the X-axis direction of the printing object surface 60*a*. The screen 66 is stretched in such a manner that the screen 66 is supported by the lower surfaces 71*a*, 72*a*, 73*a*, 74*a* of the wall 70. In other words, the screen 66 is stretched so as to form a two-dimension curved surface curved in the Z-axis direction, along the Y-axis direction, following the printing object surface 60*a*.

FIGS. 3A to 3E illustrate a structure of the printing head 40. The base block 42 of the printing head 40 is fixedly joined to the end of the rotation shaft 38 of the θ-axis stage 16 (FIG. 1), and is driven to rotate in the θ-axis direction together with the rotation shaft 38. A drive mechanism for the squeegee 48 and a drive mechanism for the doctor 52 are mounted in the base block 42. Dote that the drive mechanisms are different from each other only in configurations of the squeegee holder 45 and the doctor holder 50 and are the same in rest of configuration and disposition. Therefore, in FIG. 3, the drive mechanism for the squeegee 48 is illustrated and illustration of the drive mechanism for the doctor 52 is omitted. Two guide shafts 44, 44 are inserted through the base block 42 in parallel with each other so as to be movable in respective axis directions of the guide shafts 44, 44. The respective axes of the guide shafts 44, 44 are arranged on individual planes orthogonal to the rotation axis H of the rotation shaft 38. Also, the axes of the guide shafts 44, 44 are both arranged so as to belong to a plane parallel to a plane to which the rotation axis H of the rotation shaft 38 belongs. Respective upper ends of the guide shafts 44, 44 are fixed to a joining plate 76. Consequently, the upper ends of the guide shafts 44, 44 are joined to each other via the joining plate 76. Also, the respective lower ends of the guide shafts 44, 44 are fixed to the squeegee holder 45. Consequently, the lower ends of the guide shafts 44, 44 are joined to each other via the squeegee holder 45. The squeegee holder 45 is joined to the guide shafts 44, 44 in such a manner that an angle of the squeegee holder 45 relative to the guide shafts 44, 44 (that is, an angle in a direction around an axis F that is parallel with the X-axis) can manually be adjusted. The squeegee 48 is attached to the squeegee holder 45 at an upper edge of the squeegee 48. The guide shafts 44, 44, the joining plate 76 and the squeegee holder 45 are assembled to one another in the form of a rectangular frame. Consequently, upon movement of the guide shafts 44, 44 in the axis direction of the guide hafts 44, 44 relative to the base block 42, the squeegee 48 is translated in the movement direction.

At an intermediate position in a longitudinal direction of the joining plate 76 (that is, a position located between places at which the guide shafts 44, 44 are fixed), a hole 80 having a round shape in cross-section, the hole 80 vertically extending through the joining plate 76, is formed. A rotary knob 82 for fine adjustment of printing pressure is inserted in the hole 80 in such a manner that an axis of the hole 80 and an axis of the rotary knob 82 are coincident with each other. The rotary knob 82 is attached to the joining plate 76 so as to be rotatable around the axis of the hole 80 and be unmovable in the axis direction of the hole 80. Inside the rotary knob 82, a female screw 84 (FIG. 3B) is formed coaxially with the axis of the rotary knob 82. At an intermediate position between the guide shafts 44, 44, a drive shaft 86 is arranged in parallel with the guide shafts 44, 44. Also, an air cylinder 88 (illustrated in FIGS. 3D and 3E, and illustration of the air cylinder 88 omitted in FIG. 3A) is fixedly incorporated in the base block 42. A lower end of the drive shaft 86 is joined to a piston (not illustrated) inside the air cylinder 88. A male screw 90 (FIG. 3B) is formed at the top of the drive shaft 86. The male screw 90 is inserted into the rotary knob 92 from an opening in the bottom of the rotary knob 82 and screwed into the female screw 84. Consequently, upon the rotary knob 82 being turned with fingers, the drive shaft 86 vertically moves relative to the joining plate 76, and with the movement, the guide shafts 44, 44 vertically move relative to the base block 42. In other words, upon the rotary knob 82 being turned in one direction, the drive shaft 86 moves upward relative to the joining plate 76, and with the movement, the guide shafts 44, 44 moves downward relative to the base block 42. Also, upon the rotary knob 82 being turned in a direction opposite to the one direction, the drive shaft 86 moves downward relative to the joining plate 76, and with the movement, the guide shafts 44, 44 move upward relative to the base block 42. This operation using the rotary knob 82 is used for fine adjustment of printing pressure. A printing pressure locking screw 91 (FIG. 3C) is screwed into the joining plate 76. A distal end of the printing pressure locking screw 91 faces a place in a side surface of the rotary knob 82 inside the hole 80. A knob 91*a* is fixed to the rear of the printing pressure locking screw 91. When fine adjustment of printing pressure is performed, the knob 91*a* is turned in a loosening direction to move the distal end of the printing pressure locking screw 91 away from the place in the side surface of the rotary knob 82 the distal end faces. Consequently, the rotary knob 82 becomes rotatable, and then the rotary knob 82 is turned to perform fine adjustment of printing pressure. Upon an end of the fine adjustment of printing pressure, the knob 91*a* is turned in a tightening direction to press the distal end of the printing pressure locking screw 91 against the place in the rotary knob 82 the distal end faces. Consequently, rotation of the rotary knob 82 is locked, and the adjusted printing pressure is held.

Air hoses 92, 94 (FIG. 3D) are connected to the air cylinder 88. The upper air hose 92 communicates with a space above the piston (not illustrated) inside the air cylinder 88. The lower air hose 94 communicates with a space below the piston inside the air cylinder 88. With flow path switchover via an electromagnetic valve (not illustrated), pressurized air is supplied from the outside into the air cylinder 88 through one of the air hoses 92, 94, and air is discharged to the outside from the inside of the air cylinder 88 through the other of the air hoses 92, 94. Consequently, the piston moves to the selected one of two, upper and lower, positions an other words, when pressurized air is supplied from the upper air hose 92 and air is discharged from the lower air hose 94, the piston moves to the lower limit position and is mechanically halted. With The movement of the piston, the squeegee 48 is lowered and halts at a printing operation position at which the squeegee 48 presses the screen 66 (state during printing in FIG. 3D). Conversely, when pressurized air is supplied from the lower air hose 94 and air is discharged from the upper air hose 92, the piston moves to the upper limit position and is mechanically halted. With the movement of the piston, the squeegee 48 is raised and halts at the standby position that is apart from the screen 66 (state during ink coating in FIG. 3E).

The drive mechanism for the doctor 52 is different from the drive mechanism for the squeegee 48 in FIG. 3 only in configurations of the squeegee holder 45 and the doctor holder 50 (FIG. 4A), and is the same as the drive mechanism for the squeegee 48 in rest of configuration and disposition. In other words, with reference to FIG. 4A, two guide shafts 46, 46 (in FIG. 4A, the two guide shafts 46, 46 overlap each other) are inserted through the base block 42 in parallel with each other so as to be movable in the axis direction of the guide shafts 46, 46. The guide shafts 46, 46 are disposed so as to be in parallel with the squeegee-side guide shafts 44, 44 and face the squeegee-side guide shafts 44, 44. The respective axes of the guide shafts 46, 46 are arranged on individual planes orthogonal to the rotation axis H of the rotation shaft 38 (FIG. 3A). Also, the axes of the guide shafts 46, 46 are disposed so as to belong to a plane that is parallel to a plane to which the rotation axis H (FIG. 3A) of the rotation shaft 38 belongs. Respective upper ends of the guide shafts 46, 46 are fixed to the joining plate 96. Consequently, the upper ends of the guide shafts 46, 46 are joined to each other via the joining plate 96. Also, respective lower ends of the guide shafts 46, 46 are fixed to the doctor holder 50. Consequently, the lower ends of the guide shafts 46, 46 are joined to each other via the doctor holder 50. The doctor holder 50 is joined to the guide shafts 46, 46 in such a manner that an angle of the doctor holder 50 relative to the guide shafts 46, 46 (that as, an angle in a direction around an axis G that is parallel to the X-axis) can manually be adjusted. The doctor 52 is attached to the doctor holder 50 at an upper edge of the doctor 52. The guide shafts 46, 46, the joining plate 96 and the doctor holder 50 are assembled to one another in the form of a rectangular frame. Consequently, upon movement of the guide shafts 46, 46 in the axis direction of the guide shafts 46, 46 relative to the base block 42, the doctor 52 is translated in the movement direction.

Figure 3A:
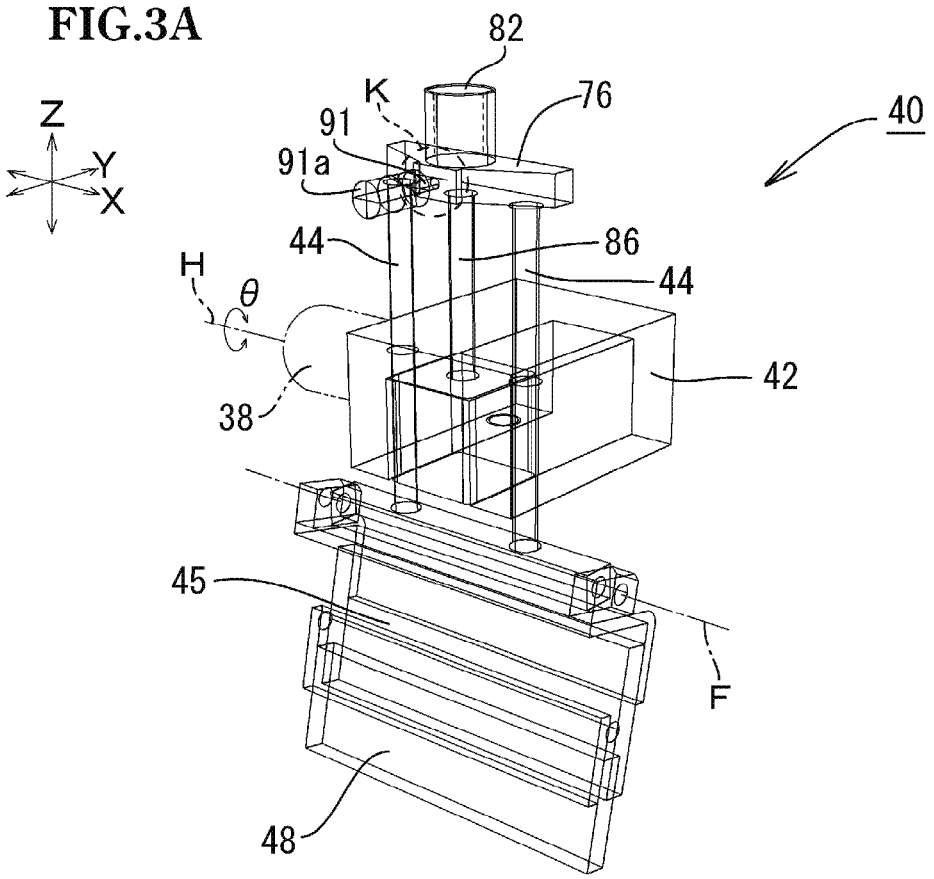
FIG. 3A is a perspective view illustrating the printing head in FIG. 1 (illustration of a part relating to a doctor omitted).
Figure 3B:
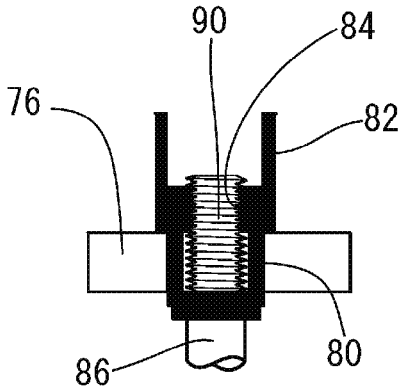
FIG. 3B is a diagram of an inner structure of the printing pressure fine adjustment mechanism in FIG. 3A (inner structure of part L in FIG. 3D) as viewed from the front side of a squeegee.
Figure 3C:
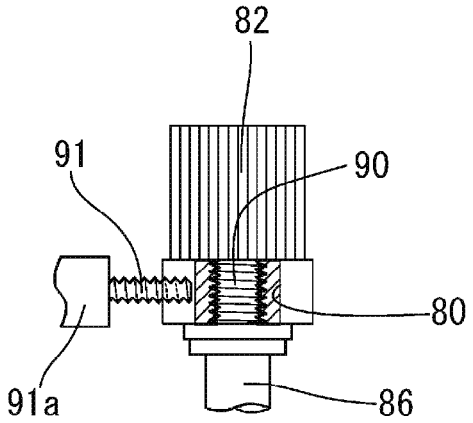
FIG. 3C is a diagram of an inner structure of the printing pressure locking mechanism in FIG. 3A (inner structure of part K in FIG. 3A) as viewed from a lateral side of the squeegee.
Figure 3D:
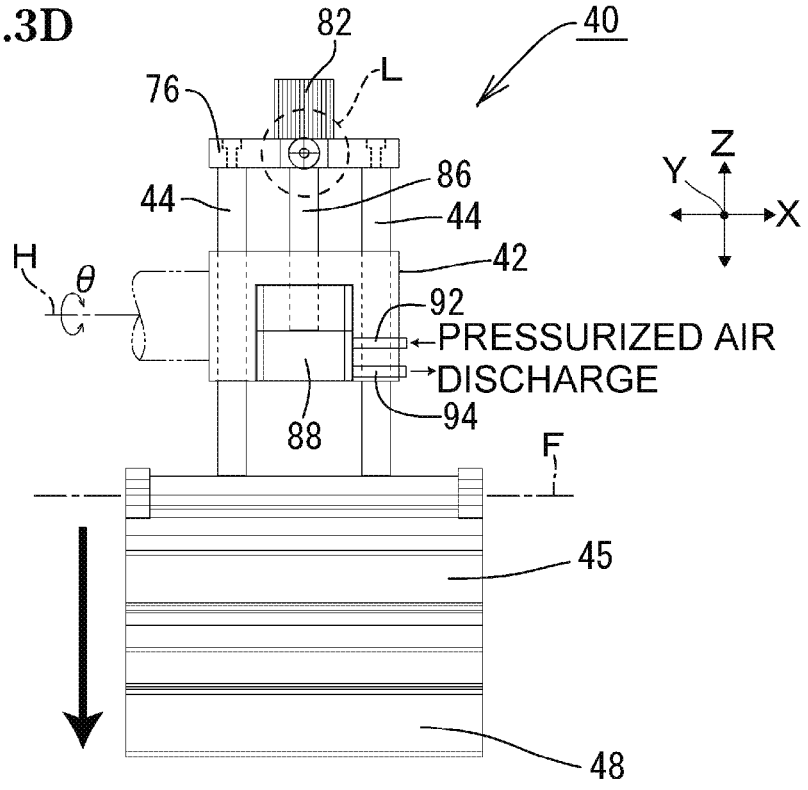
FIG. 3D is a diagram of the printing head in FIG. 3A as viewed from the front of the squeegee, which illustrates a state in which the squeegee is in a lowered, printing operation position.
Figure 3E:
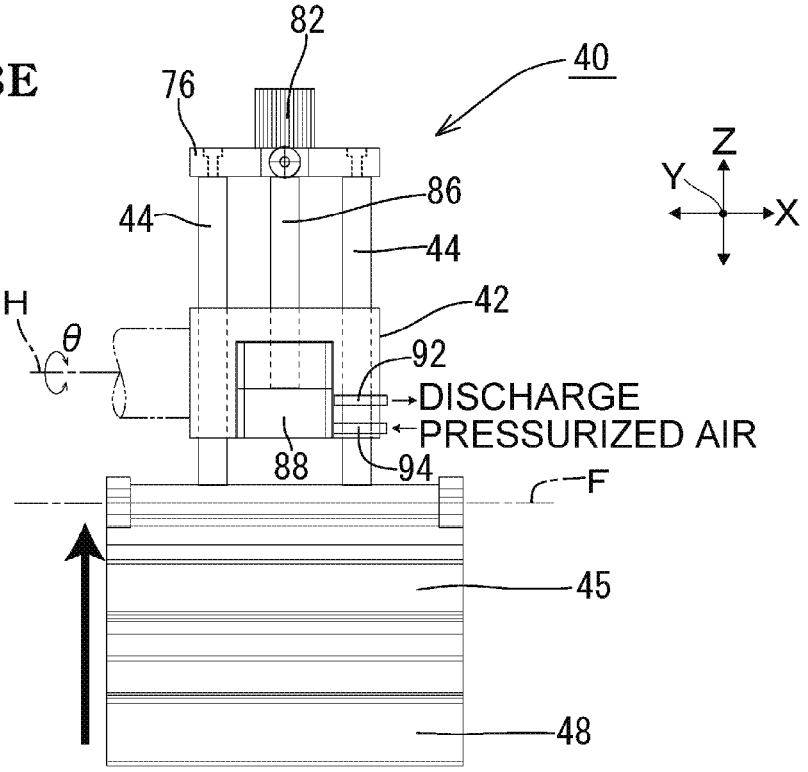
FIG. 3E is a diagram of the printing head in FIG. 3A as viewed from the front of the squeegee, which illustrates a state in which the squeegee is in a raised, standby position.

A fine adjustment mechanism and a locking mechanism for doctor pressure (force causing the doctor 52 to press the screen 66 during ink coating) have respective configurations that are the same as those in FIGS. 3B and 30, which illustrate the fine adjustment mechanism and the locking mechanism for printing pressure. In other words, in FIG. 4A, at an intermediate position in a longitudinal direction (direction orthogonal to the sheet of FIG. 4A) of the joining plate 96 (that is, a position located between places at which the guide shafts 46, 46 are fixed), a hole having a round shape in cross-section (not illustrated and corresponding to the squeegee-side hole 80 in FIG. 3B), the hole vertically extending through the joining plate 96, is formed. A rotary knob 98 for fine adjustment of doctor pressure (corresponding to the squeegee-side rotary knob 82) is inserted in the hole in such a manner that an axis of the hole and an axis of the rotary knob 98 are coincident with each other. The rotary knob 98 is attached to the joining plate 96 so as to be rotatable around the axis of the hole and be unmovable in the axis direction of the hole. Inside the rotary knob 98, a female screw (not illustrated and corresponding to the squeegee-side female screw 84 in. FIG. 3B) is formed coaxially with the axis of the rotary knob 98. At an intermediate position between the guide shafts 46, 46, a drive shaft (not illustrated and corresponding to the squeegee-side drive shaft 86 in FIG. 3A) is disposed in parallel with the guide shafts 46, 46. Also, an air cylinder 100 (corresponding to the squeegee-side air cylinder 88) is incorporated and fixed in the base block 42. A lower end of the drive shaft is joined to a piston (not illustrated) inside the air cylinder 100. A male screw (not illustrated and corresponding to the squeegee-side male screw 90 in FIG. 3B) is formed at the top of the drive shaft. The male screw is inserted into the rotary knob 98 from an opening in the bottom of the rotary knob 98 and screwed into the female screw. Consequently, upon the rotary knob 98 being turned with fingers, the drive shaft vertically moves relative to the joining plate 96, and with the movement, the guide shafts 46, 46 vertically move relative to the base block 42. In other words, upon the rotary knob 98 being turned in one direction, the drive shaft moves upward relative to the joining plate 96, and with the movement, the guide shafts 46, 46 move downward relative to the base block 42. Also, upon the rotary knob 98 being turned in a direction opposite to the one direction, the drive shaft moves downward relative to the joining plate 96, and with the movement, the guide shafts 46, 46 move upward relative to the base block 42. This operation using the rotary knob 98 is used for fine adjustment of doctor pressure. A doctor pressure locking screw 102 (corresponding to the squeegee-side printing pressure locking screw 91) is screwed into the joining plate 96. A distal end of the doctor pressure locking screw 102 faces a place in a side surface of the rotary knob 98 inside the hole. A knob 102*a* (corresponding to the squeegee-side knob 91*a*) is fixed to the rear of the doctor pressure locking screw 102. When fine adjustment of doctor pressure is performed, the knob 102*a* is turned in a loosening direction to move the distal end of the doctor pressure locking screw 102 away from the place in the side surface of the rotary knob 98 the distal end faces. Consequently, the rotary knob 98 becomes rotatable, and then the rotary knob 98 is turned to perform fine adjustment of doctor pressure. Upon an end of the fine adjustment of doctor pressure, the knob 102*a* is turned in a tightening direction to press the distal end of the doctor pressure locking screw 102 against the place in the side surface of the rotary knob 98 the distal end faces. Consequently, rotation of the rotary knob 98 is locked, and the adjusted doctor pressure is held.

Air hoses 104, 106 (corresponding to the squeegee-side air hoses 92, 94) are connected to the air cylinder 100. The upper air hose 104 communicates with a space above the piston (not illustrated) inside the air cylinder 100. The lower air hose 106 communicates with a space below the piston inside the air cylinder 100. With flow path switchover via an electromagnetic valve (not illustrated), pressurized air is supplied from the outside into the air cylinder 100 through one of the air hoses 104, 106, and air is discharged to the outside from the inside of the air cylinder 100 through the other of the air hoses 104, 106. Consequently, the piston moves to the selected one of two, upper and lower positions. In other words, when pressurized air is supplied from the upper air hose 104 and air is discharged from the lower air hose 106, the piston moves to the lower limit position and is mechanically halted. With the movement of the piston, the doctor 52 is lowered, presses the screen 66 and halts at an ink coating operation position (state during ink coating in FIG. 4C). Conversely, when pressurized air is supplied from the lower air hose 106 and air is discharged from the upper air hose 104, the piston moves to the upper limit position and is mechanically halted. With the movement of the piston, the doctor 52 is raised and halts at a standby position that is apart from the screen 66 (state during printing in FIG. 4B).

FIGS. 4A to 4C indicate operation modes of the printing head 40. FIG. 4A illustrate a neutral state in which neither printing nor ink coating is performed. At this time, pressurized air is supplied from the respective lower air hoses 94, 106 and air is discharged from the respective upper air hoses 92, 104, whereby the squeegee 48 and the doctor 52 are both held in the respective raised positions. Next, FIG. 4B illustrates a state during printing. At this time, the squeegee 48 is in the lowered position and thus is in contact with the printing object surface 60*a* under predetermined printing pressure via the screen 66. The doctor 52 is in the raised position and thus is apart from the screen 66. In this state, the printing head 40 is transported in a printing direction (rightward in FIG. 4B) to perform printing. FIG. 4C illustrates a state during ink coating. At this time, the squeegee 48 is in the raised position and thus is apart from the screen 66. The doctor 52 is in the lowered position and thus is in contact with the screen 66 under predetermined doctor pressure. In this state, the printing head 40 is transported in an ink coating direction (leftward in FIG. 4C) to perform ink coating.

Figure 5:
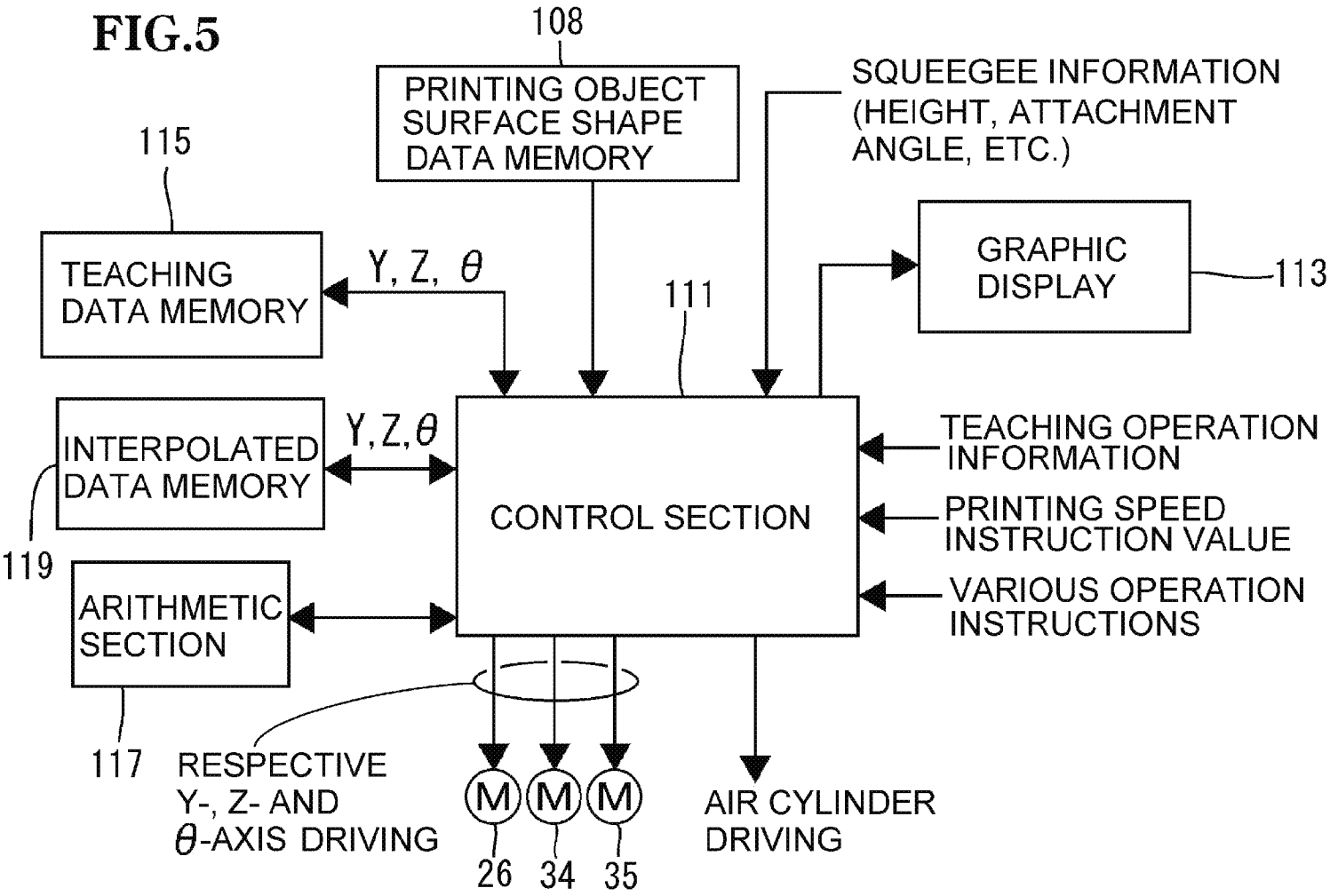
FIG. 5 is a block diagram illustrating an embodiment of a control system for a screen printing device according to this invention, the control system being a control system that controls the mechanism section in FIG. 1.

FIG. 5 illustrates a control system that controls the mechanism section in FIG. 1. A printing object surface shape data memory 108 stores data on a cross-sectional shape of the printing object surface 60*a* based on, e.g., CAD data. This shape data is represented by positional data in a Y-Z coordinate system of the mechanism section in FIG. 1. At the time of teaching, based on this shape data, a control section 111 causes a graphic display 113 to provide graphic display of a positional relationship between the printing head 40 and the printing object surface 60*a* on the Y-Z coordinate plane. An operator (teaching person) performs teaching for each of appropriate positions, along the printing direction, in the printing object surface 60*a*, on the graphic display screen via an off-line teaching operation. This teaching operation is performed as follows. The printing head 40 displayed on the graphic display screen is moved in respective Y-, Z- and θ-axis directions (At this time, the squeegee 48 is set in the lowered position). At an appropriate position in the printing object surface 60*a* displayed on the display screen, a distal end of the squeegee 48 is brought into abutment with the position while an attack angle formed by a direction tangent to the position in the Y-Z plane and the squeegee 48 is maintained as a predetermined angle. At this time, an instruction to store respective Y-, Z- and θ-axis coordinate values as measurement data (teaching data) for that position (teaching point) is provided. The storage instruction causes the teaching data to be stored in a teaching data memory 115. This teaching operation is performed for each of appropriate positions, along the printing direction, in the printing object surface 60*a*. Consequently, in the teaching data memory 115, the teaching data (Y-, Z- and θ-axis coordinate values) on each of appropriate teaching points, along the printing direction, in the printing object surface 60*a* is stored. An arithmetic section 117 performs interpolation operation such as spline operation for the respective axis coordinate values stored in the teaching data memory 115, based on an arithmetic operation start instruction provided by the operator. As a result of the interpolation operation, the arithmetic section 117 obtains Y, Z, θ values for each of positions with an interval of a unit distance Δd (very small distance for interpolation between teaching points) along the printing object surface 60*a*. The Y, Z, θ values obtained as above are stored in an interpolated data memory 119. Upon the operator setting a printing speed and providing an instruction to execute printing in a state in which the Y, Z, θ values are stored in the interpolated data memory 119 in this manner, printing is executed. In other words, upon an instruction to execute printing being provided, the control section 111 performs the following control. The squeegee 48 located at a printing operation start position is lowered to the lowered position, and the doctor 52 is raised to the raised position. At time intervals according to the designated printing speed, Y, Z, θ values stored in the interpolated data memory 119 are sequentially read and output as position instruction values to the servo motors 26, 34, 35 for the respective axes. Consequently, while the squeegee 46 maintains the predetermined attack angle, the distal end of the squeegee 48 moves along the printing object surface 60*a* at the designated constant speed and rubs the printing object surface 60*a* via the screen 66 to perform printing on the printing object surface 60*a*. Upon the squeegee 48 reaching a printing end position, the control section 111 performs the following control. The movements on the respective Y, Z, θ axes are halted. The squeegee 48 is raised to the raised position and thus moved apart from the screen 66. The doctor 52 is lowered and brought into contact with the screen 66. The printing head 40 is transported toward the side opposite to that for the printing in the Y-axis direction and is caused to perform an ink coating operation. At this time, a Z-axis position of the printing head 40 is moved along the curve of the screen 66. Although detailed description of the control for the Z-axis position movement will be omitted, the control can be performed, for example, based on an off-line teaching operation for the doctor 52, which is similar to the above-described off-line teaching operation for the squeegee 48.

Figure 6:
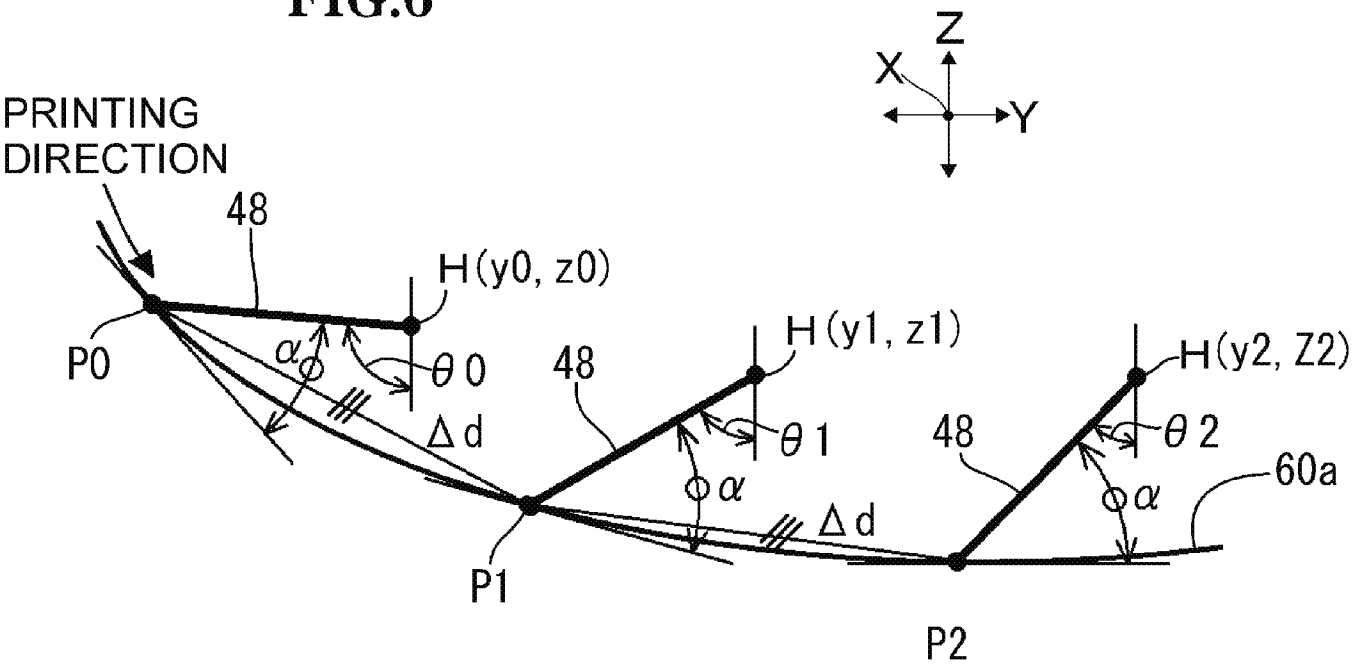
FIG. 6 is an explanatory diagram of control performed by the control section in FIG. 5 during printing.

Here, the aforementioned control during printing by the control section 111 will be described with reference to FIG. 6. This control is control for performing printing while maintaining the attack angle as the predetermined angle, keeping the distal end of the squeegee 48 in contact with the printing position and moving the distal end of the squeegee 48 along the printing object surface 60*a* at a designated constant speed. As described above, in the interpolated data memory 119, the Y, Z, θ values for each of the positions with an interval of the unit distance Δd along the printing object surface 60*a* along which the distal end of the squeegee 48 advances with the attack angle maintained as the predetermined angle and the distal end of the squeegee 48 in contact with the printing position are stored. The printing positions P0, P1, P2, . . . in FIG. 6 indicate positions, on the Y-Z plane, of the distal end of the squeegee 48 when the distal end of the squeegee 48 advances every unit distance Δd along the printing object surface 60*a* from the arbitrary position P0 in the printing object surface 60*a*. Coordinate values (yi, zi) (i=0, 1, 2, . . . ) are Y-Z coordinate values of the rotation axis H of the squeegee 48. The coordinate value θi (i=0, 1, 2, . . . ) indicates an angle of the squeegee 48 in the direction around the rotation axis H with reference to the Z-axis direction on the Y-Z plane. Y, Z, θ values (yi, zi, θi) stored in the interpolated data memory 119 for each of the printing positions P0, P1, P2, . . . are as follows.

Y, Z, θ values (y0, z0, θ0) for the printing position P0: Y, Z, θ values that enable obtainment of a predetermined attack angle α in a state in which the distal end of the squeegee 48 is in contact with the position P0

Y, Z, θ values (y1, z1, θ1) for the printing position P1: Y, Z, θ values that enable obtainment of the predetermined attack angle α in a state in which the distal end of the squeegee 48 is in contact with the position P1 (position the printing position reaches when the printing position advances the unit distance Δd from the position P0 along the printing object surface 60*a*)

Y, Z, θ values (y2, z2, θ2) for the printing position P2: Y, Z, θ values that enable obtainment of the predetermined attack angle α in a state in which the distal end of the squeegee 48 is in contact with the position P2 (position the printing position reaches when the printing position advances the unit distance Δd from the position P1 along the printing object surface 60*a*)

At the time of printing, the control section 111 sequentially reads the Y, Z, θ values for the printing position P0, P1, P2, . . . stored in the interpolated data memory 119 at time intervals Δt according to a designated printing speed and outputs the Y, Z, θ values as position instruction values to the servo motors 26, 34, 35 for the respective axes. In other words, at a certain time t0, Y, Z, θ values for the position P0 is read and output as position instruction values for the respective axes. At a time t0+Δt, the Y, Z, θ values for the position P1 are read and output as position instruction values for the respective axes. At a time t0+2Δt, the Y, Z, θ values for the position P2 are read and output as position instruction values for the respective axes. Likewise, the Y, Z, θ values for the position P4, P5, P6, . . . are read at intervals of time Δt and sequentially output as position instruction values for the respective axes. Consequently, the distal end of the squeegee 48 performs printing or the printing object surface 60*a* while moving on the printing object surface 60*a* along the printing object surface 60*a* at a constant speed Δd/Δt and maintaining the predetermined attack angle α.

Figure 7:
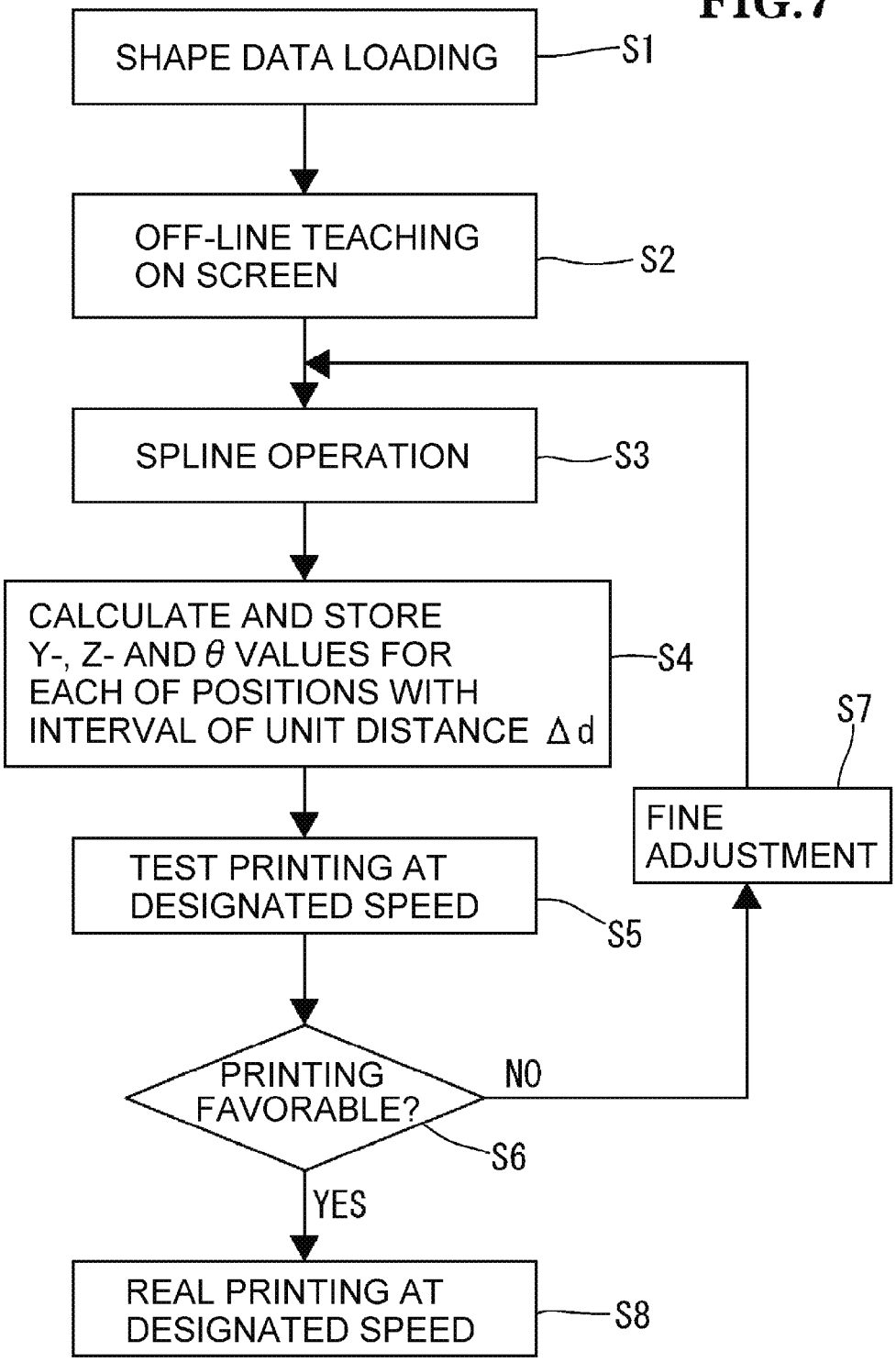
FIG. 7 is a flowchart illustrating an example of a procedure for printing work performed by a screen printing device including the mechanism section in FIG. 1 and the control system in FIG. 5.

FIG. 7 illustrates a procedure of screen printing work using the above-described screen printing device 10. The work procedure in FIG. 7 will be described. Data on a cross-sectional shape of the printing object surface 60*a* based on, e.g., CAD data is loaded into the printing object surface shape data memory 108 (S1). Teaching of Y, Z, θ values is performed for each. of appropriate positions along a printing direction in the printing object surface 60*a*, on the display screen of the graphic display 113 via an off-line teaching operation (S2). The Y, Z, θ values for the respective taught positions are stored in the teaching data memory 115. After teaching is performed for from a printing start position to a printing end position, interpolation operation such as spline operation is performed by the arithmetic section 117 for the respective Y, Z, θ values for the taught positions, based on an instruction from an operator (S3). Consequently, Y, Z, θ values for positions with an interval of a unit distance Δd along the printing object surface 60*a* are obtained. The obtained interpolated data is stored in the interpolated data memory 119 (S4). Using the interpolated data stored in the interpolated data memory 119, test printing is performed at a designated real printing speed (S5). If a result of the test printing includes a defective printing part ("NO" in S6), fine adjustment is performed (S7). This fine adjustment is performed by, e.g., fine adjustment of printing pressure via the rotary knob 82 (FIG. 3A) or re-teaching (off-line teaching, direct teaching or teaching playback) for the defective printing part. If re-teaching for the defective printing part is performed, teaching data on the defective printing part stored in the teaching data memory 115 for the defective printing part is updated by teaching data obtained by the re-teaching. The arithmetic section 117 re-performs interpolation operation such as spline operation based on the updated teaching data. The content of the interpolated data memory 119 is updated by new interpolated data (Y, Z, θ values with an interval of the unit distance Δd along the printing object surface 60*a*). Next test printing is performed based on the updated interpolated data. Test printing and fine adjustment are repeated until a favorable printing result is obtained for the entire printing object surface 60*a*. If a favorable printing result is obtained for the entire printing object surface 60*a* ("YES" in S6), real printing is performed at a speed that is the same as that of the test printing (S8).

Figure 8:
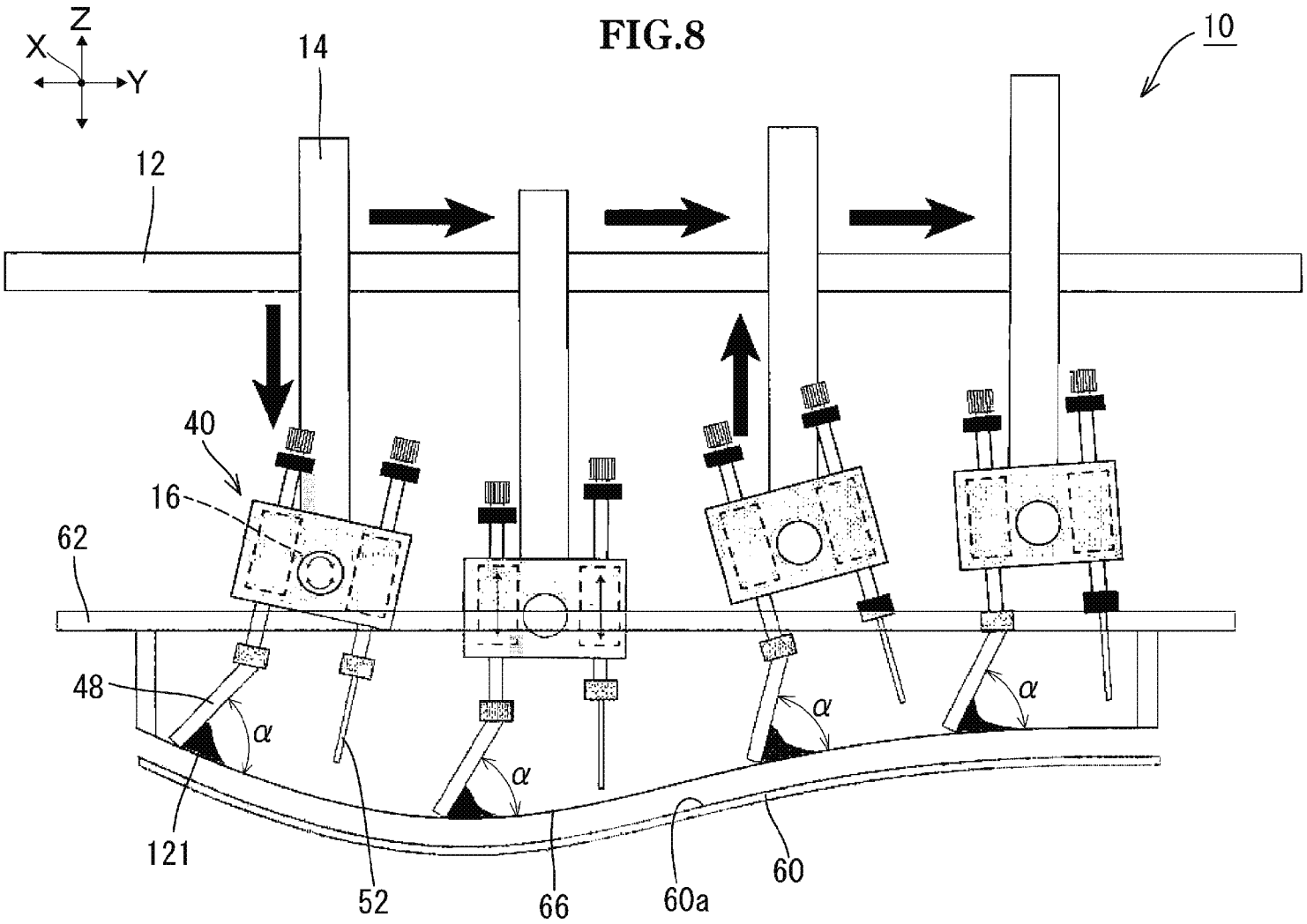
FIG. 8 is a diagram, along the Y-Z, plane, of an example operation of the mechanism section of the screen printing device in FIG. 1 during printing.

FIG. 8 illustrates operation of the printing head 40 during printing. In FIG. 8, for simplicity of illustration, the screen 66 and the printing object surface 60*a* are fully apart from each other in the Y-axis direction, but in reality, as a matter of course, the screen 66 and the printing object surface 60*a* come into contact with each other at a printing position (position at which the distal end of the squeegee 48 comes into contact with the screen 66). Control of the respective I-, and θ-axes causes the squeegee 48 to rub the printing object surface 60*a* via the screen 66 to perform printing on the printing object surface 60*a*, with the predetermined attack angle a maintained, while maintaining a bank of an ink 121.

Figure 9:
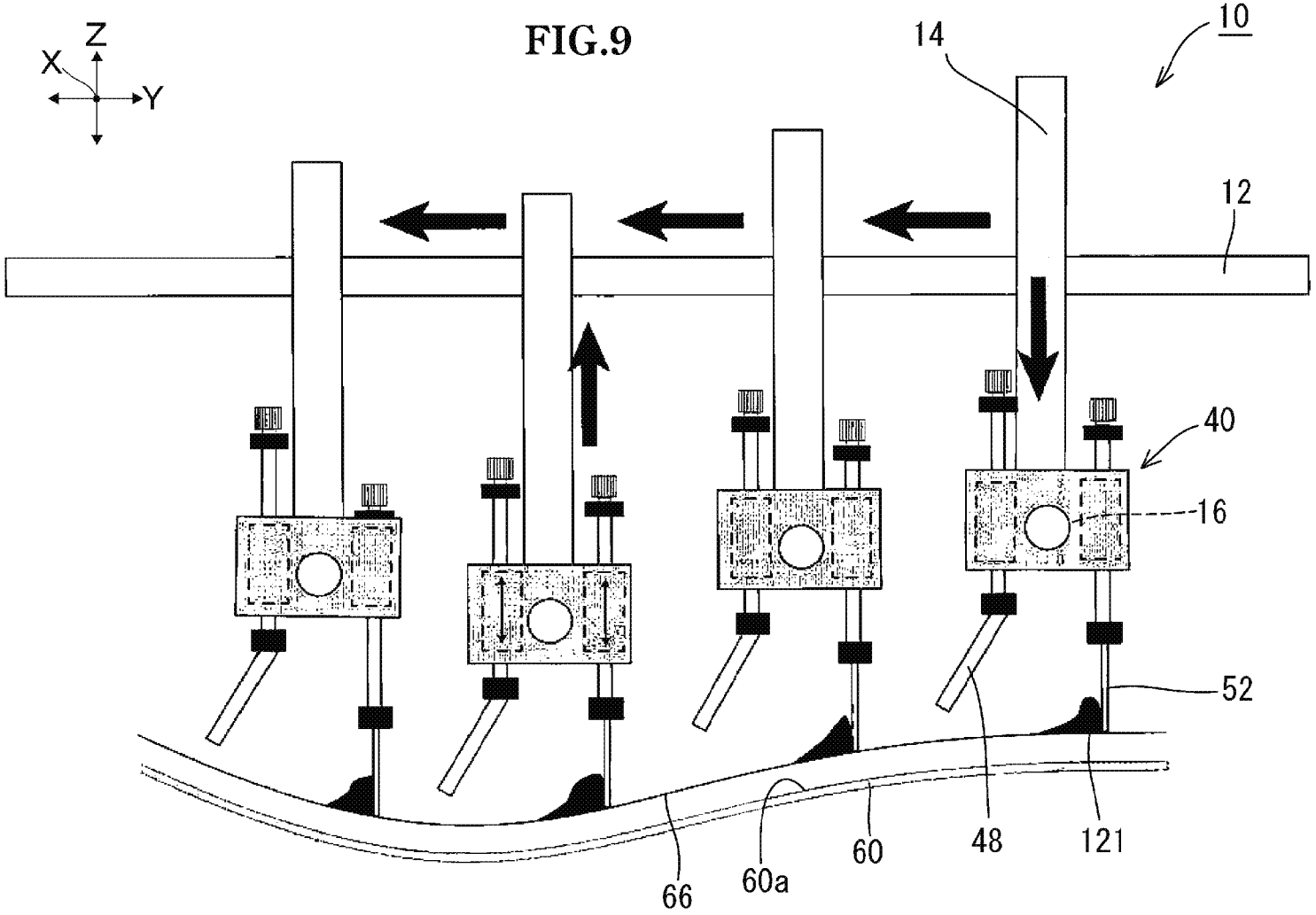
FIG. 9 is a diagram, along the Y-Z, plane, of an example operation of the mechanism section of the screen printing device in FIG. 1 during ink coating.

FIG. 9 illustrates a return (ink coating) operation after the printing end position is reached. At this time, the squeegee 48 is in the raised position, and the doctor 52 is in the lowered position. The Y-and Z-axes are driven with the θ-axis kept fixed, to cause a distal end of the doctor 52 to rub the screen 66 to apply the ink 121 to the screen 66 in preparation for next printing.

Figure 10:
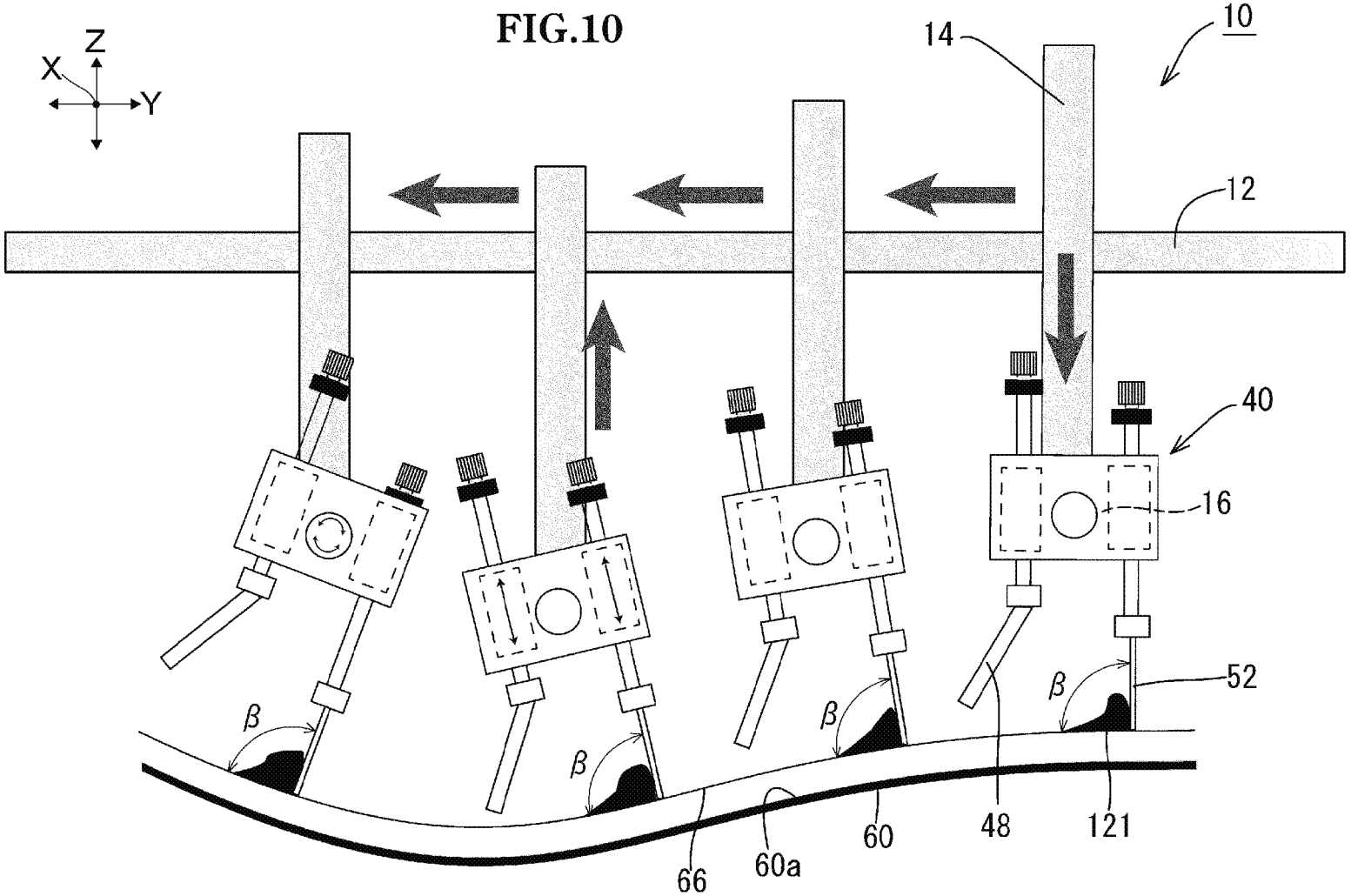
FIG. 10 is a diagram, along the Y-Z, plane, of another example operation of the mechanism section of the screen printing device in FIG. 1 during ink coating.

FIG. 10 is another example of return (ink coating) operation after the printing end position is reached. This example is configured to perform ink coating while, at a position at which the doctor 52 comes into contact with the screen 66, maintaining an angle (doctor angle) β formed by a direction tangent to the position in the screen 66 and the doctor 52 as a predetermined angle. In order to achieve such operation, the θ-axis is driven in addition to the Y- and Z-axes. Accordingly, uniform ink coating can be performed on the screen. 66 free from the influence of the cross-sectional shape of the screen 66. As a result, next printing can be performed with high precision or high quality. The control for maintaining the doctor angle β as the predetermined angle during ink coating can be performed, for example, in a manner that is similar to the above-described control maintaining the attack angle α as the predetermined angle during printing. In other words, the control can be performed based on off-line teaching using data on the cross-sectional shape of the printing object surface 60*a*, according to a procedure that is similar to that in FIG. 7. Alternatively, the control can be performed according to a procedure that is similar to that in FIG. 11 described later.

Figure 11:
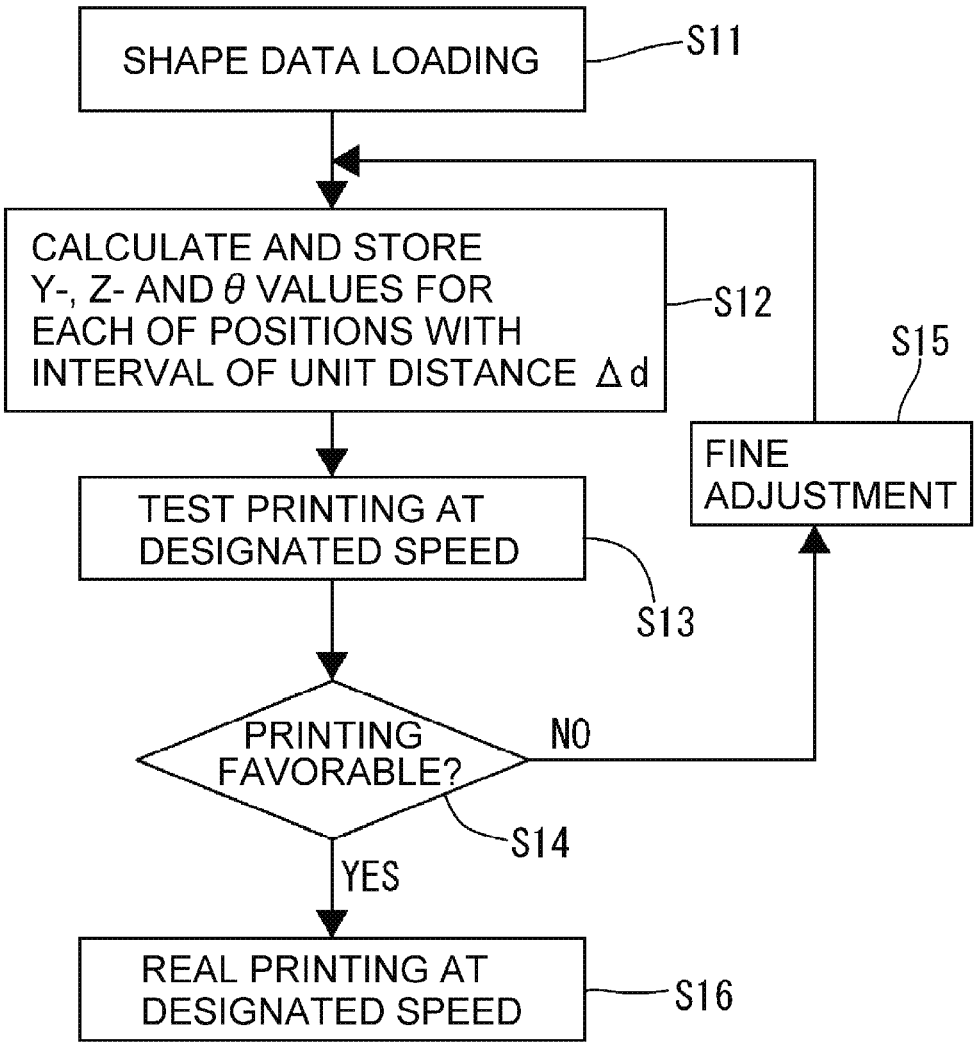
FIG. 11 is a flowchart illustrating another example of a procedure for printing work performed by a screen printing device including the mechanism section in FIG. 1 and the control system in FIG. 5.

In the above work procedure in FIG. 7, teaching of Y, Z, θ values for each of appropriate positions along the printing direction in the printing object surface 60*a* is performed via an off-line teaching operation based on the data on the cross-sectional shape of the printing object surface 60*a*, and teaching data obtained by the teaching is subjected to interpolation operation to obtain Y, Z, θ values for positions the distal end of the squeegee 48 reaches when the distal end of the squeegee 48 advances every unit distance Δd along the printing object surface 60*a*. However, if data on a cross-sectional shape of the printing object surface 60*a* is determined, for a position in the printing object surface 60*a*, a set of Y-, Z- and θ-axis positions for bringing the distal end of the squeegee 48 into contact with the position while the squeegee 48 maintains the predetermined attack angle is determined. Therefore, Y Z, θ values for each of positions the distal end of the squeegee 48 reaches when the distal end of the squeegee 48 advances every unit distance Δd along the printing object surface 60*a* can also be obtained directly from the data on the cross-sectional shape of the printing object surface 60*a*. FIG. 11 illustrates an example of a work procedure as an alternative to FIG. 7 in such a case. The work procedure in FIG. 11 will be described reusing the control system in FIG. 5. Data on a cross-sectional shape of the printing object surface 60*a* based on, e.g., CAD data is loaded into the printing object surface shape data memory 108 (S11). Based on the shape data, the arithmetic section 117 obtains Y, Z, θ values for each of positions the distal end of the squeegee 48 reaches when the distal end of the squeegee 48 advances every unit distance Δd along the printing object surface 60*a* while the squeegee 48 maintains the predetermined attack angle α. In other words, referring back to FIG. 6, Y, Z, θ values for each of positions P0, P1, P2, . . . the distal end of the squeegee 48 reaches when the distal end of the squeegee 48 advances every unit distance Δd along the printing object surface 60*a* while maintaining the attack angle α, that is, P0 (y0, z0, θ0), P1 (y1, z1, θ1), P2 (y2, z2, θ2), . . . are obtained. The obtained Y, Z, θ values for each of the positions are stored in the interpolated data memory 119 (S12). Using the data stored in the interpolated data memory 119, test printing is performed at a designated speed for real printing (S13). If a result of the test printing includes a defective printing part ("NO" in S14), fine adjustment is performed (S15). This fine adjustment is performed by, e.g., fine adjustment of printing pressure via the rotary knob 82 (FIG. 3) or teaching (off-line teaching, direct teaching or teaching playback) for the defective printing part. If teaching for the defective printing part is performed, data on the defective printing, part in the interpolated data memory 119 is corrected based on the teaching data obtained by the teaching. Next test printing is performed based on the corrected data. Test printing and fine adjustment are repeated until a favorable printing result is obtained for the entire printing object surface 60*a*. If a favorable printing result is obtained for the entire printing object surface 60*a* ("YES" in S14), real printing is performed at a speed that is the same as that of the test printing (S16).

In the above embodiment, before execution of printing, information indicating a mutual relationship among respective Y-, Z- and θ-axis positions is obtained and set based on data on a cross-sectional shape of a printing object surface, and printing is performed while respective axis positions of a squeegee are controlled based on the set information. However, if an operation speed is high, it is possible that: during execution of printing, information indicating a mutual relationship among respective Y-, Z- and θ-axis positions is obtained in real time based on, e.g., data on a cross-sectional shape of a printing object surface; and printing is performed while respective axis positions of a squeegee are controlled. Also, in the above embodiment, control of positions in the Y-axis direction and the Z-axis direction is performed by moving the printing head in the Y-axis direction and the Z-axis direction with the printing object surface fixed. Contrarily, it is possible that printing is performed by moving a printing object surface in the Y-axis direction and the Z-axis direction with the printing head fixed. Also, in the above embodiment, the cross-sectional shape of the screen 66 is made to be identical to the cross-sectional shape of the printing object surface. However, a cross-sectional shape of a screen does not need to be identical to a cross-sectional shape of a printing object surface and may be a shape substantially following a cross-sectional shape of a printing object surface. In this case, a mutual relationship among respective Y-, Z- and θ-axis positions can be obtained based on data on the cross-sectional shape of the screen (that is, a shape substantially following the cross-sectional shape of the printing object surface).

The invention claimed is:

1. A screen printing method for screen printing on a printing object surface having a cross-sectional shape curving along a printing advancing direction, the method comprising:

where the printing advancing direction is defined as a Y-axis, a direction orthogonal to the Y-axis and belonging to the cross-section is defined as a Z-axis and a direction around an axis orthogonal to a Y-Z plane is defined as a θ-axis, and where a position in the θ-axis direction corresponds to an angle around the axis orthogonal to the Y-Z plane with reference to a reference position around the axis orthogonal to the Y-Z plane, providing a controller and a memory;

disposing a squeegee so as to be movable in respective Y-, Z- and θ-axis directions relative to the printing object surface;

storing information in the memory, the information being obtained based on data on the cross-sectional shape of the printing object surface or data on a shape approximating the cross-sectional shape, and the information indicating a mutual relationship among respective Y-, Z- and θ-axis positions, the mutual relationship enabling performing printing while maintaining or substantially maintaining a printing angle formed by a direction tangent to a printing position in the printing object surface in the Y-Z plane and the squeegee, and the controller adjusting the position of the squeegee in the θ-axis direction based upon the mutual relationship such that the printing angle formed by the direction tangent to the printing position in the printing object surface in the Y-Z plane and the squeegee is maintained or substantially maintained; and executing printing while controlling with the controller the respective Y-, Z- and θ-axis positions of the squeegee relative to the printing object surface according to the stored information indicating the mutual relationship among the respective Y-, Z- and θ-axis positions.

2. The screen printing method according to claim 1, comprising:

obtaining the information indicating the mutual relationship among the respective Y-, Z- and θ-axis positions before execution of printing and setting the information in advance; and executing printing while controlling the respective Y-, Z- and θ-axis positions of the squeegee relative to the printing object surface according to the set information indicating the mutual relationship among the respective Y-, Z- and θ-axis positions.

3. The screen printing method according to claim 1, wherein the data on the cross-sectional shape of the printing object surface or the data on the shape approximating the cross-sectional shape is CAD data.

4. The screen printing method according to claim 1, wherein the information indicating the mutual relationship among the respective Y-, Z- and θ-axis positions is obtained as information with variation in the Y-axis position and the Z-axis position due to variation in the θ-axis position taken into consideration.

5. The screen printing method according to claim 1, wherein the printing is executed using a screen having a cross-sectional shape curving along the printing advancing direction so as to follow or substantially follow the printing object surface.

6. The screen printing method according to claim 1, wherein the printing is executed while a printing speed in the direction tangent to the printing position in the printing object surface in the Y-Z plane is maintained or substantially maintained.

7. The screen printing method according to claim 6, wherein control of the printing speed is performed by obtaining the information indicating the mutual relationship among the respective Y-, Z- and θ-axis positions for each of positions with an interval of a predetermined distance along the printing object surface before execution of printing, setting the information in advance, and sequentially reading the information at a time interval according to a designated printing speed and providing the information as position instruction values for the respective Y, Z, θ-axes to control the respective axes.

8. The screen printing method according to claim 1, comprising:

providing the controller with a servo motor, the controller being configured to rotate the squeegee in the θ-axis direction about a rotational shaft via the servo motor.

9. A screen printing device for screen printing on a printing object surface having a cross-sectional shape curving along a printing advancing direction, where the printing advancing direction is defined as a Y-axis, a direction orthogonal to the Y-axis and belonging to the cross-section is defined as a Z-axis and a direction around an axis orthogonal to a Y-Z plane is defined as a θ-axis, and where a position in the θ-axis direction corresponds to an angle around the axis orthogonal to the Y-Z plane with reference to a reference position around the axis orthogonal to the Y-Z plane, the apparatus comprising:

a controller;

a memory;

a squeegee;

a doctor; and a mover that moves the squeegee relative to the printing object surface in respective Y-, Z- and θ-axis directions;

the memory storing information obtained based on data on the cross-sectional shape of the printing object surface or data on a shape approximating the cross-sectional shape, and the information indicating a mutual relationship among respective Y-, Z- and θ-axis positions, the mutual relationship enabling performing printing while maintaining or substantially maintaining a printing angle formed by a direction tangent to a printing position in the printing object surface in the Y-Z plane and the squeegee, and at a time of printing via the squeegee, the controller controls the mover according to the information stored in the memory so as to control the respective Y-, Z- and θ-axis positions of the squeegee relative to the printing object surface to be respective positions according to the information, and wherein the controller is configured to adjust the position of the squeegee in the θ-axis direction via the mover and based upon the information stored in memory indicating the mutual relationship such that the printing angle formed by the direction tangent to the printing position in the printing object surface in the Y-Z plane and the squeegee is maintained or substantially maintained.

10. The screen printing device according to claim 9, comprising the memory storing, in advance, the information indicating the mutual relationship among the respective Y-, Z- and θ-axis positions in a form of information that is a combination of positional data of the respective Y-, Z- and θ-axis positions.

11. The screen printing device according to claim 10, wherein:

the memory stores the information indicating the mutual relationship among the respective Y-, Z- and θ-axis positions for each of positions with an interval of a predetermined distance along the printing object surface; and the controller sequentially reads the information indicating the mutual relationship among the respective Y-, Z- and θ-axis positions at a time interval according to a designated printing speed, from the memory and provides the information as position instruction values for the respective Y-, Z- and θ-axes to control the respective axes.

12. The screen printing device according to claim 9, wherein:

the mover includes a mechanism that moves the squeegee and the doctor together in the respective Y-, Z- and θ-axis directions relative to the printing object surface; and the controller obtains the information indicating the mutual relationship among respective Y-, Z- and θ-axis positions from the memory so as to enable returning of an ink while maintaining or substantially maintaining an angle formed by a direction tangent to a screen and the doctor at a place of abutment between the doctor and the screen when the doctor returns the ink or the information is set in the controller, and at a time of return of the ink by the doctor, the controller controls respective Y-, Z- and θ-axis positions of the doctor relative to the screen according to the obtained or set information indicating the mutual relationship among the respective Y-, Z- and θ-axis positions.

13. The screen printing device according to claim 9, wherein the controller comprises a servo motor that is configured to rotate the squeegee in the θ-axis direction about a rotational shaft.

* * * * *